US012187561B2

(12) United States Patent
Ishibe et al.

(10) Patent No.: US 12,187,561 B2
(45) Date of Patent: Jan. 7, 2025

(54) SHEET CONVEYING DEVICE

(71) Applicant: BROTHER KOGYO KABUSHIKI KAISHA, Nagoya (JP)

(72) Inventors: Akinari Ishibe, Okazaki (JP); Hideaki Yoshimune, Nagoya (JP); Hikaru Tamura, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 68 days.

(21) Appl. No.: 17/520,870

(22) Filed: Nov. 8, 2021

(65) Prior Publication Data

US 2022/0144570 A1 May 12, 2022

(30) Foreign Application Priority Data

Nov. 12, 2020 (JP) ..... 2020-188522

(51) Int. Cl.
*B65H 1/04* (2006.01)
*B65H 7/14* (2006.01)
(Continued)

(52) U.S. Cl.
CPC ..... *B65H 1/04* (2013.01); *B65H 7/14* (2013.01); *B65H 9/04* (2013.01); *B65H 9/06* (2013.01);
(Continued)

(58) Field of Classification Search
CPC ... B65H 1/04; B65H 3/34; B65H 7/02; B65H 7/04; B65H 7/14; B65H 9/04; B65H 9/06;
(Continued)

(56) References Cited

U.S. PATENT DOCUMENTS

2002/0008352 A1 1/2002 Hanano
2007/0090585 A1* 4/2007 Harada ..... G03G 15/602 271/8.1
(Continued)

FOREIGN PATENT DOCUMENTS

JP H08-018704 A 1/1996
JP 2000-351452 A 12/2000
(Continued)

OTHER PUBLICATIONS

Japan Patent Office, Notice of Reasons for Refusal issued in Japanese Patent Application No. 2020-188522, dated Sep. 13, 2024.

*Primary Examiner* — Prasad V Gokhale
(74) *Attorney, Agent, or Firm* — Baker Botts L.L.P.

(57) ABSTRACT

A sheet conveying device includes a tray, a device body having a conveying route of a sheet and supporting the tray, a side guide supported by the tray to be movable in a first direction intersecting with a conveying direction of the sheet and contacting an end portion in the first direction of the sheet placed on the tray, a cover rotatable with respect to the device body and covering the conveying route, and a lock lever locking the cover to the device body and provided in a position overlapping the side guide in a second direction intersecting with the conveying direction and the first direction. The lock lever is rotatable between a lock position where the cover is locked and a release position where the cover is released. The side guide includes a first notched portion facing a rotation track of the lock lever with a gap.

7 Claims, 20 Drawing Sheets

(51) Int. Cl.

| | |
|---|---|
| ***B65H 9/04*** | (2006.01) |
| ***B65H 9/06*** | (2006.01) |
| *B65H 5/06* | (2006.01) |

(52) U.S. Cl.
CPC ..... *B65H 5/06* (2013.01); *B65H 2402/441* (2013.01); *B65H 2402/45* (2013.01); *B65H 2402/60* (2013.01); *B65H 2405/114* (2013.01); *B65H 2405/115* (2013.01); *B65H 2405/121* (2013.01); *B65H 2511/12* (2013.01); *B65H 2553/46* (2013.01)

(58) Field of Classification Search
CPC ..... B65H 2402/31; B65H 2402/44; B65H 2402/441; B65H 2402/45; B65H 2402/60; B65H 2405/114; B65H 2405/1144; B65H 2405/115; B65H 2405/12; B65H 2405/121; B65H 2511/12
See application file for complete search history.

(56) References Cited

U.S. PATENT DOCUMENTS

| | | | | |
|---|---|---|---|---|
| 2007/0120316 | A1* | 5/2007 | Shiohara | B65H 1/266 271/145 |
| 2010/0225977 | A1* | 9/2010 | Osanai | G03G 15/602 271/4.1 |
| 2013/0193632 | A1* | 8/2013 | Hida | B65H 3/0684 271/10.11 |
| 2013/0201537 | A1* | 8/2013 | Fujiwara | H04N 1/00591 358/498 |
| 2015/0336756 | A1* | 11/2015 | Lee | H04N 1/0066 271/240 |
| 2020/0239255 | A1* | 7/2020 | Okazaki | B65H 1/04 |

FOREIGN PATENT DOCUMENTS

| | | | |
|---|---|---|---|
| JP | 2002-012343 | A | 1/2002 |
| JP | 2004-149301 | A | 5/2004 |
| JP | 2006-117382 | A | 5/2006 |
| JP | 2017-007790 | A | 1/2017 |

* cited by examiner

SHEET CONVEYING DEVICE

CROSS-REFERENCE TO RELATED APPLICATION

This application is based upon and claims the benefit of priority from prior Japanese patent application No. 2020-188522, filed on Nov. 12, 2020, the entire contents of which are incorporated herein by reference.

TECHNICAL FIELD

The present disclosure relates to a sheet conveyor device having a side guide which guides an end portion in a width direction of a sheet.

BACKGROUND

For example, as disclosed in JP-A-H08-018704, a sheet conveying device configured to align both sides a document stacked on a document placement stand by a slider capable of sliding in a direction orthogonal to a document conveying direction is known. In the sheet conveying device, an upper document guide configured to guide a document at an upper part of a conveying path is provided to be openable/closable with respect to a lower document guide facing the upper document guide in an upper and lower direction. The upper document guide is locked to the lower document guide by a guide lock.

In a case where a position of a lock lever configured to lock a cover which covers the conveying route to a device body and positions of side guides configured to guide both end portions in a width direction of a sheet are overlapped in a direction intersecting with the conveying direction, i.e., in the upper and lower direction, a dimension of the entire device in the upper and lower direction increases so as to avoid interference between the lock lever and the side guides.

SUMMARY

An object of the present disclosure is to provide a sheet conveying device capable of avoiding interference between a lock lever and a side guide while suppressing an increase in dimension of an entire device in an upper and lower direction.

In order to achieve the above object, the present disclosure provides a sheet conveying device including:

- a tray on which a sheet is placed;
- a device body having a conveying route through which the sheet is conveyed in a conveying direction, and supporting the tray;
- a side guide supported by the tray to be movable in a first direction intersecting with the conveying direction, and capable of contacting an end portion in the first direction of the sheet placed on the tray;
- a cover provided to be rotatable with respect to the device body, and covering the conveying route; and
- a lock lever configured to lock the cover to the device body, and provided in a position overlapping the side guide in a second direction intersecting with the conveying direction and the first direction,
- in which the lock lever is configured to be rotatable between a lock position in which the cover is locked to the device body and a release position in which a locked state of the cover to the device body is released, and
- the side guide includes a first notched portion configured to face a rotation track of the lock lever with a predetermined gap.

In the present disclosure, the side guide supported on the tray is movable in the first direction intersecting with the conveying direction. Thereby, when placing the sheet on the tray, the user can smoothly insert the sheet onto the conveying route while aligning the sheet by bringing the side guide into contact with the end portion of the sheet in the first direction. The cover covering the conveying route is provided to be rotatable with respect to the device body having the tray, and the user can appropriately expose the conveying route by opening the cover. In a state where the cover is closed, the cover is locked to the device body by the lock lever.

In a case where the position of the lock lever and the position of the side guide are overlapped in the second direction intersecting with the conveying direction and the first direction, the entire device may be enlarged in the second direction so as to avoid the interference. Therefore, in the present disclosure, the side guide is provided with the first notched portion configured to face the rotation track of the lock lever with the predetermined gap. Thereby, since the positions of the lock lever and the side guide can be arranged closer to each other in the second direction by a dimension of the notched shape, the increase in dimension of the entire device in the second direction can be suppressed.

As a result, according to the present disclosure, it is possible to avoid the interference between the lock lever and the side guide while suppressing the increase in dimension of the entire device in the upper and lower direction.

According to the present disclosure, it is possible to avoid the interference between the lock lever and the side guide while suppressing the increase in dimension of the entire device in the upper and lower direction.

DETAILED DESCRIPTION

Hereinafter, an embodiment of the present disclosure will be described with reference to the drawings. Note that, the drawings are used so as to describe the technical features that can be adopted by the present disclosure, and the described configurations and the like of the device are not intended to be limited thereto but are merely explanatory examples.

Overall Schematic Configuration of Complex Machine

Figure 1:
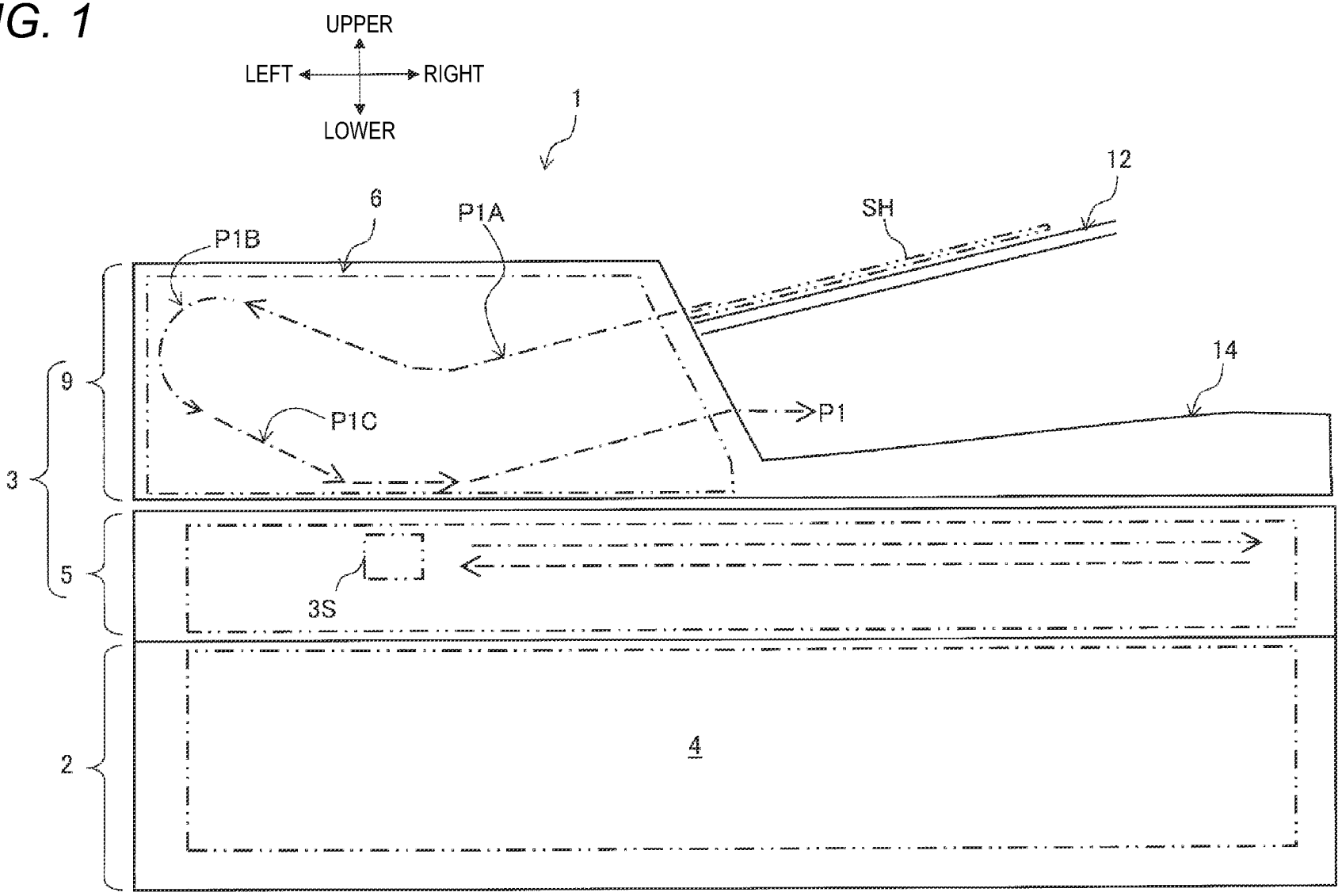
FIG. 1 is a schematic view showing a conceptual entire configuration of a complex machine according to an embodiment of the present disclosure.

FIG. 1 conceptually shows an overall schematic configuration of a complex machine 1 according to the present embodiment. As for the complex machine 1 shown in FIG. 1, the front, rear, left, right, upper and lower directions are each indicated while prescribing the front side of the drawing sheet as the front and the left side of the drawing sheet as the left. The directions shown in the subsequent drawings are indicated corresponding to the directions shown in FIG. 1.

As shown in FIG. 1, the complex machine 1 includes a body unit 2 and a reading unit 3. The reading unit 3 includes an ADF (Auto Document Feeder) unit 9 and an FB unit 5. A front surface of the FB unit 5 of the ADF unit 9 is provided with an operation panel (not shown) such as a touch panel. The ADF unit 9 is an example of the sheet conveying device.

As shown in FIG. 1, the body unit 2 has a substantial flat box shape, and is provided therein with an image forming unit 4. The image forming unit 4 forms an image on a recording sheet based on image data received from a PC connected to the complex machine 1, image data generated as a result of a document image being read by the reading unit 3, and the like by an inkjet method, a laser method or the like. The reading unit 3 is arranged above the body unit 2. The FB unit 5 is used when reading an image of a document placed on a document support surface 101A, which will be described later. The ADF unit 9 includes a supply tray 12, a discharge tray 14 and a conveying unit 6. The conveying unit 6 conveys a sheet SH placed on the supply tray 12 along a conveying path P1, and discharges the sheet onto the discharge tray 14. The ADF unit 9 is used when reading images of the sheets SH placed on the supply tray 12 while sequentially conveying the sheets along the conveying path P1. Note that, the sheet to be read includes a document and the like, in addition to a sheet such as a paper sheet, an OHP sheet and the like.

Appearance of ADF Unit

Figure 2:
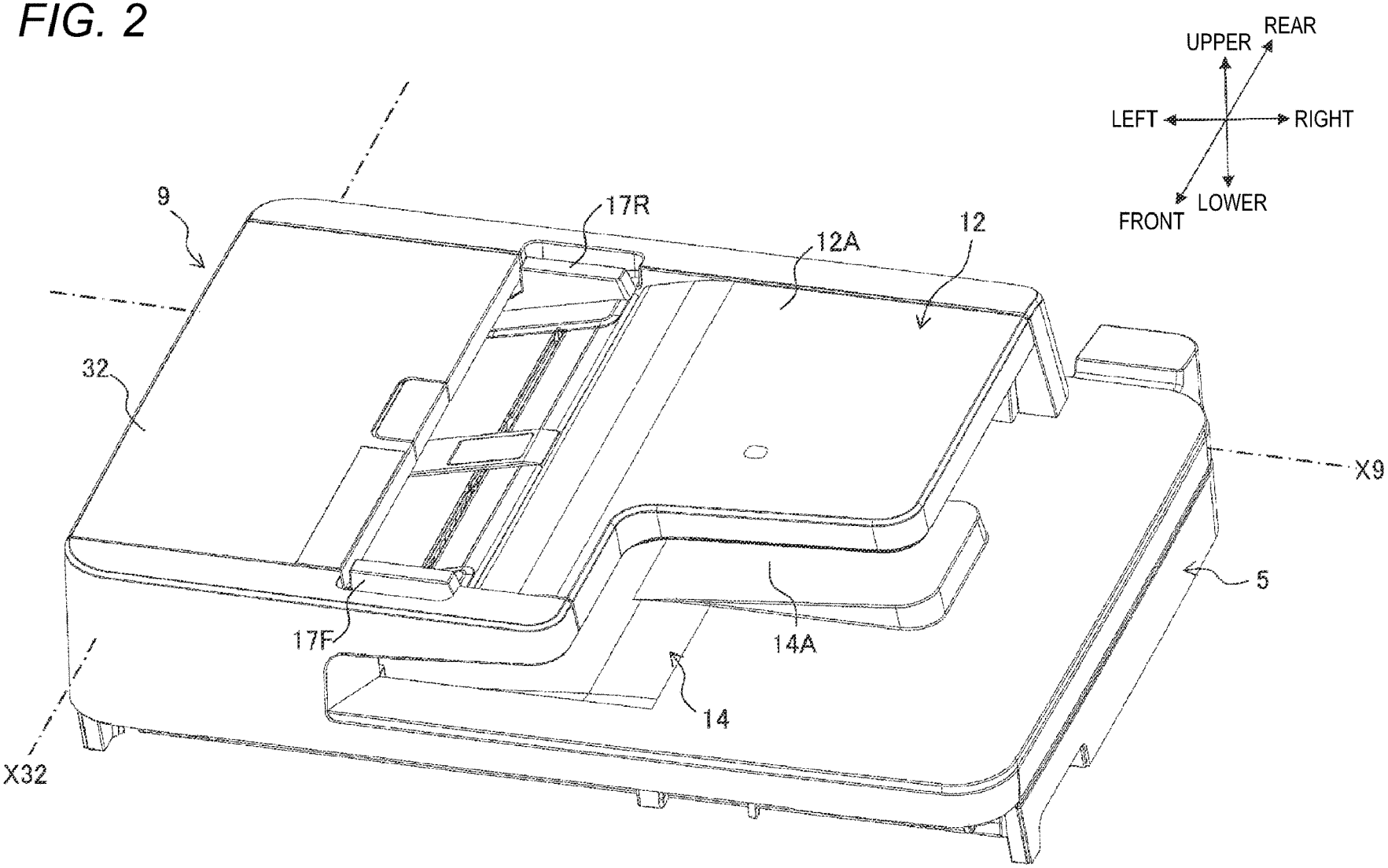
FIG. 2 is a perspective view showing an appearance configuration of the complex machine.
Figure 3:
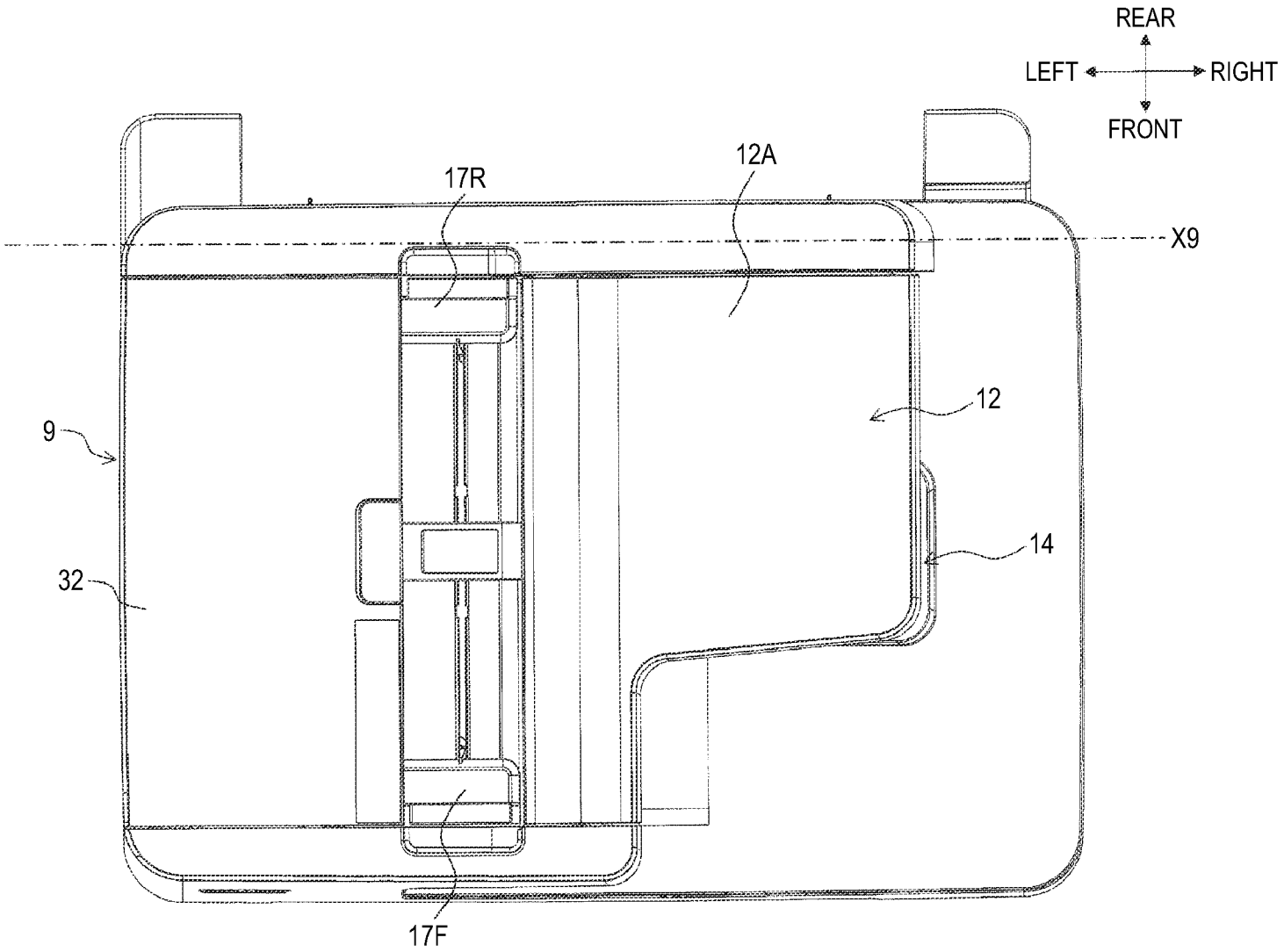
FIG. 3 is a plan view showing the appearance configuration in a state where a first side guide and a second side guide are spaced.

An appearance configuration of the ADF unit 9 is shown in FIGS. 2 and 3. As shown in FIGS. 2 and 3, the ADF unit 5 is supported to be swingable around an opening/closing shaft center X9 extending in the right and left direction by a hinge (not shown) arranged at the rear part. In the state shown in FIGS. 2 and 3, the ADF unit 9 covers the document support surface 101A from above, which will be described later. Although not shown, the ADF unit 9 is configured to swing around the opening/closing shaft center X9 so that a front end portion thereof is displaced upward and backward, thereby exposing the document support surface 101A. Thereby, a user can support the document to be read on the document support surface 101A.

Figure 4:
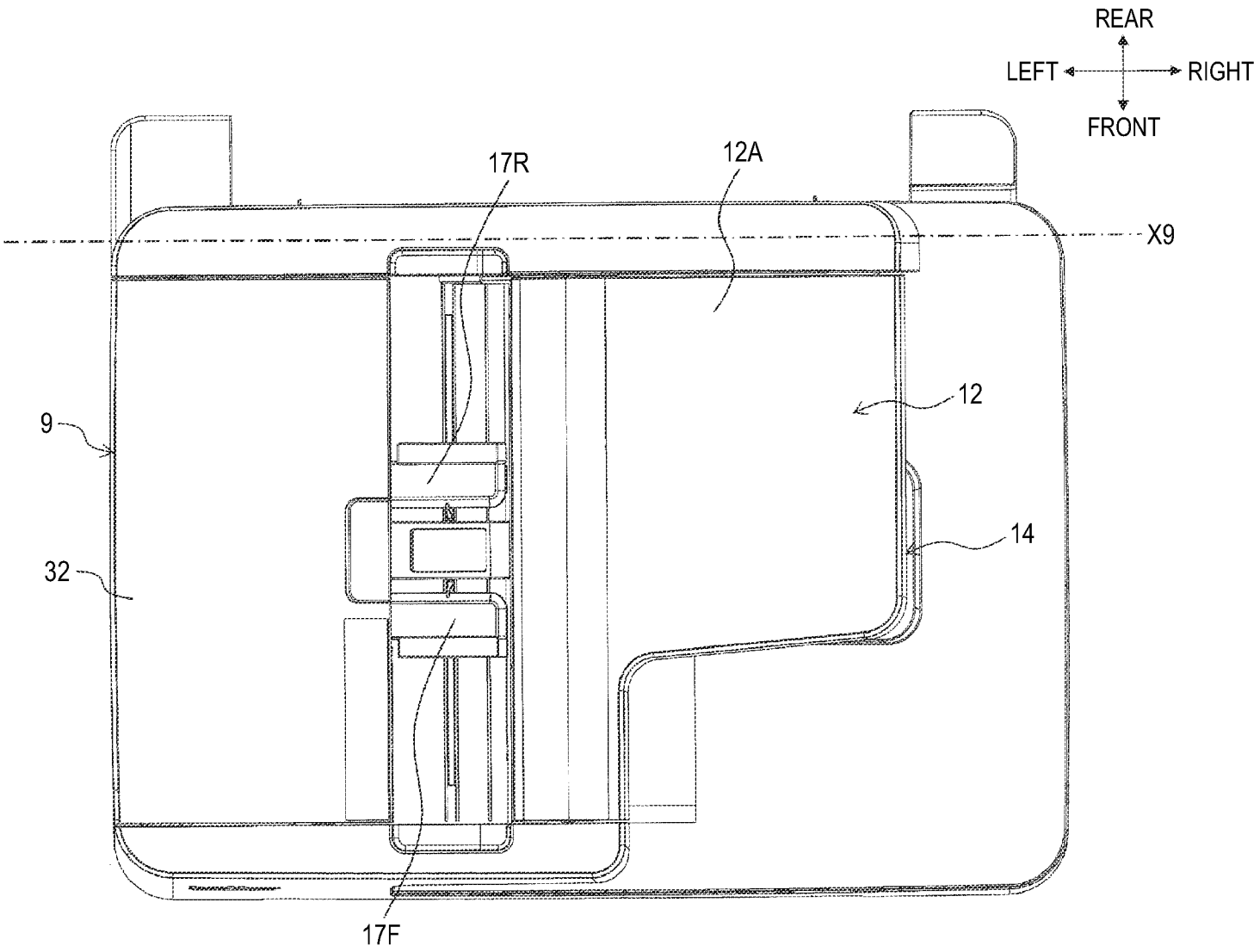
FIG. 4 is a plan view showing the appearance configuration in a state where the first side guide and the second side guide are brought close to each other.

As shown in FIGS. 2 to 4, the supply tray 12 is formed at a right part of the ADF unit 9. The supply tray 12 is an example of the tray. An upper surface of the supply tray 12 is a sheet feeding surface 12A on which the sheet SH is supported from below. A plurality of sheets SH to be read, which is to be conveyed by the conveying unit 6, is stacked on the sheet feeding surface 12A. The sheet feeding surface 12A is a flat surface inclined downward to the left. The supply tray 12 is provided with a first side guide 17F and a second side guide 17R each of which is provided to be slidable in the front and rear direction. The first side guide 17F and the second side guide 17R are an example of the side guide. The first side guide 17F and the second side guide 17R are brought close to each other and are spaced from each other, thereby sandwiching a plurality of types of sheets SH of different sizes supported on the supply tray 12 in the front and rear direction. Specifically, an end portion on a rear side of the first side guide 17F is contacted to an end portion on a front side of the sheet SH, and the end portion on the front side is an example of the end portion in the first direction. An end portion on a front side of the second side guide 17R is contacted to an end portion on a rear side of the sheet SH, and the end portion on the rear side is another example of the end portion in the first direction. FIG. 3 shows a state in which the first side guide 17F and the second side guide 17R are spaced from each other, and FIG. 4 shows a state in which the first side guide 17F and the second side guide 17R are brought close to each other. Note that, in the below, the first side guide 17F and the second side guide 17R are collectively referred to as 'side guide 17' as appropriate. This also applies to the drawings. As shown in FIGS. 2 to 4, the discharge tray 14 is positioned below the supply tray 12. An upper surface of the discharge tray 14 is a sheet discharge surface 14A on which the sheet SH is supported from below. On the sheet discharge surface 14A, the sheet SH whose image has been read by an image sensor 3S and discharged by the conveying unit 6 is stacked. The sheet discharge surface 14A is a flat surface inclined upward from the left toward the right.

As shown in FIGS. 2 to 4, an opening/closing cover 32 is provided at an upper part of the ADF unit 9. The opening/closing cover 32 is a substantially flat plate member extending from a substantial center to the left end of the ADF unit 9 in the front and rear direction and in the right and left direction. The opening/closing cover 32 is an example of the cover. A left end portion of the opening/closing cover 32 is bent downward. The opening/closing cover 32 is supported at a lower end portion of a left end thereof to be swingable around an opening/closing shaft center X32 extending in the front and rear direction. Thereby, the opening/closing cover 32 can be displaced between a closed position shown with a solid line in FIGS. 2 to 4 and an opened position shown in FIG. 6 and the like. In the closed position, the opening/closing cover 32 functions to cover the conveying path P1.

Sectional Structure of Reading Unit

Figure 5:
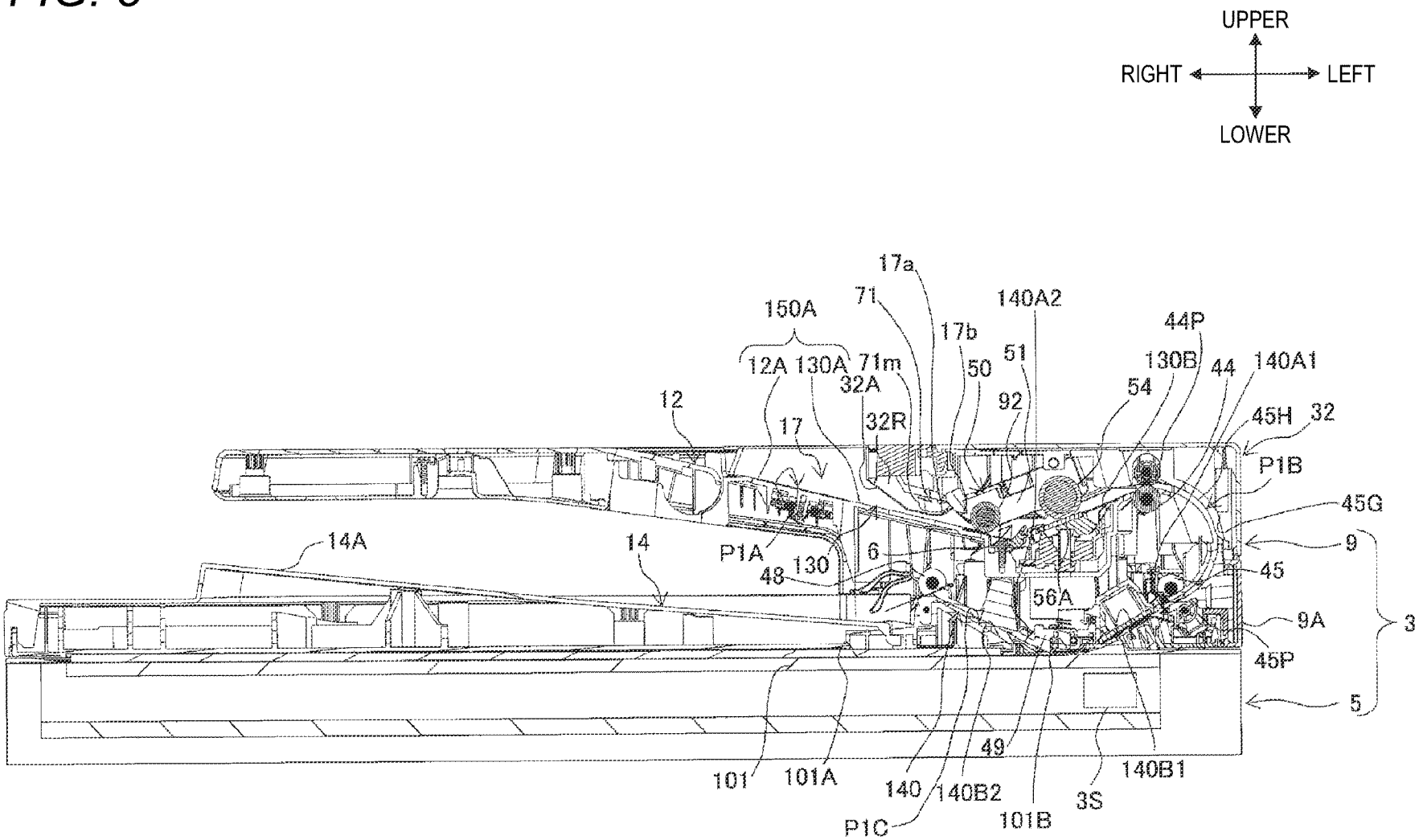
FIG. 5 is a cross-sectional view showing a sectional structure of main parts of a reading unit, as seen from rear.
Figure 6:
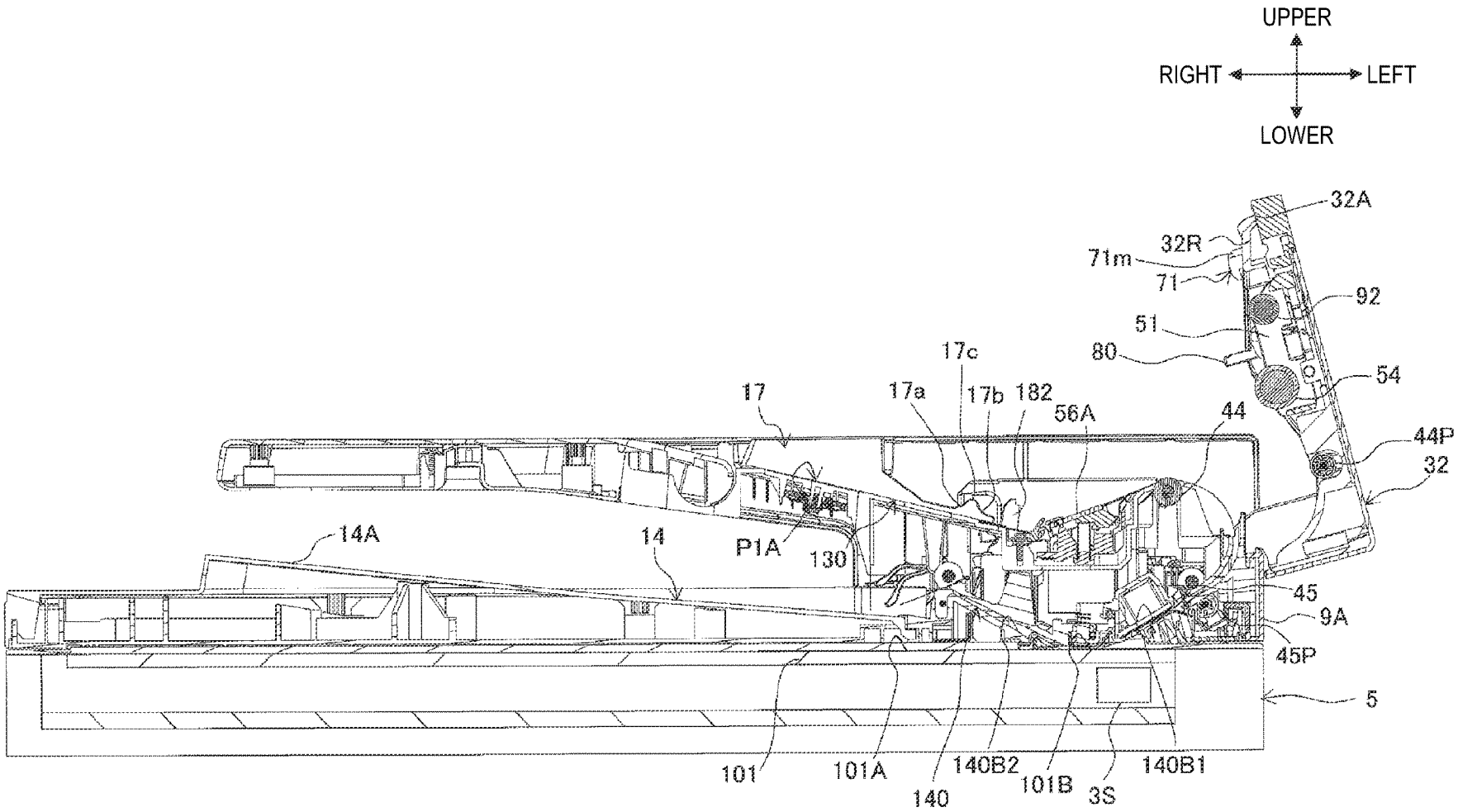
FIG. 6 is a cross-sectional view showing a state where an opening/closing cover is opened in the structure shown in FIG. 5.

FIG. 5 shows a sectional structure of main parts of the reading unit 3, as seen from rear, and FIG. 6 shows a state in which the opening/closing cover 32 is opened in the sectional structure. In FIGS. 5 and 6, a platen glass 101 is arranged on the upper surface of the FB unit 5. An upper surface of the platen glass 101 forms the document support surface 101A. The image sensor 3S is provided to be movable in the right and left direction below the platen glass 101 in the FB unit 5. When reading an image of a stationary document by the image sensor 3S, the document support surface 101A supports the document from below.

An upper surface of the platen glass 101 forms a reading surface 101B. When reading an image of the sheet SH, which is being conveyed one by one by the conveying unit 6, by the image sensor 3S in the FB unit 5, the reading surface 101B guides the sheet SH being conveyed from below. Note that, in the present embodiment, a target whose image is read using the document support surface 101A is referred to as the document, and a target whose image is read while being conveyed by the conveying unit 6 is referred to as the sheet SH. The document and the sheet SH may be substantially the same.

The FB unit 5 includes the image sensor 3S, a scanning mechanism (not shown), and the platen glass 101. The scanning mechanism is configured to reciprocally move the image sensor 3S below the document support surface 101A and the reading surface 101B in the right and left direction. When reading an image of the document supported on the document support surface 101A, the image sensor 3S reads the document while moving below the document support surface 101A. When reading an image while conveying the sheet SH by the conveying unit 6, the image sensor 3S is stopped in a predetermined stationary reading position. Here, the stationary reading position in which the image sensor 3S is stopped is a position facing the reading surface 101B from below. As the image sensor 3S, a well-known image reading sensor such as a CIS (Contact Image Sensor) and a CCD (Charge Coupled Device) is used.

A base member 9A is provided at a lower part of the ADF unit 9. The base member 9A constitutes a bottom part of the ADF unit 9. A right part of the base member 9A constitutes the discharge tray 14. The conveying unit 6 is provided between the opening/closing cover 32 and a left part of the base member 9A of the ADF unit 9. The conveying unit 6 includes an upper chute member 130 and a lower chute member 140 attached to the base member 9A. The lower chute member 140 is positioned below the upper chute member 130. The base member 9A is positioned below the lower chute member 140. Note that, parts of the ADF unit 9 except the supply tray 12 and the opening/closing cover 32, i.e., the base member 9A, the upper chute member 130 and the lower chute member 140, and the FB unit 5 are an example of the device body.

Figure 7:
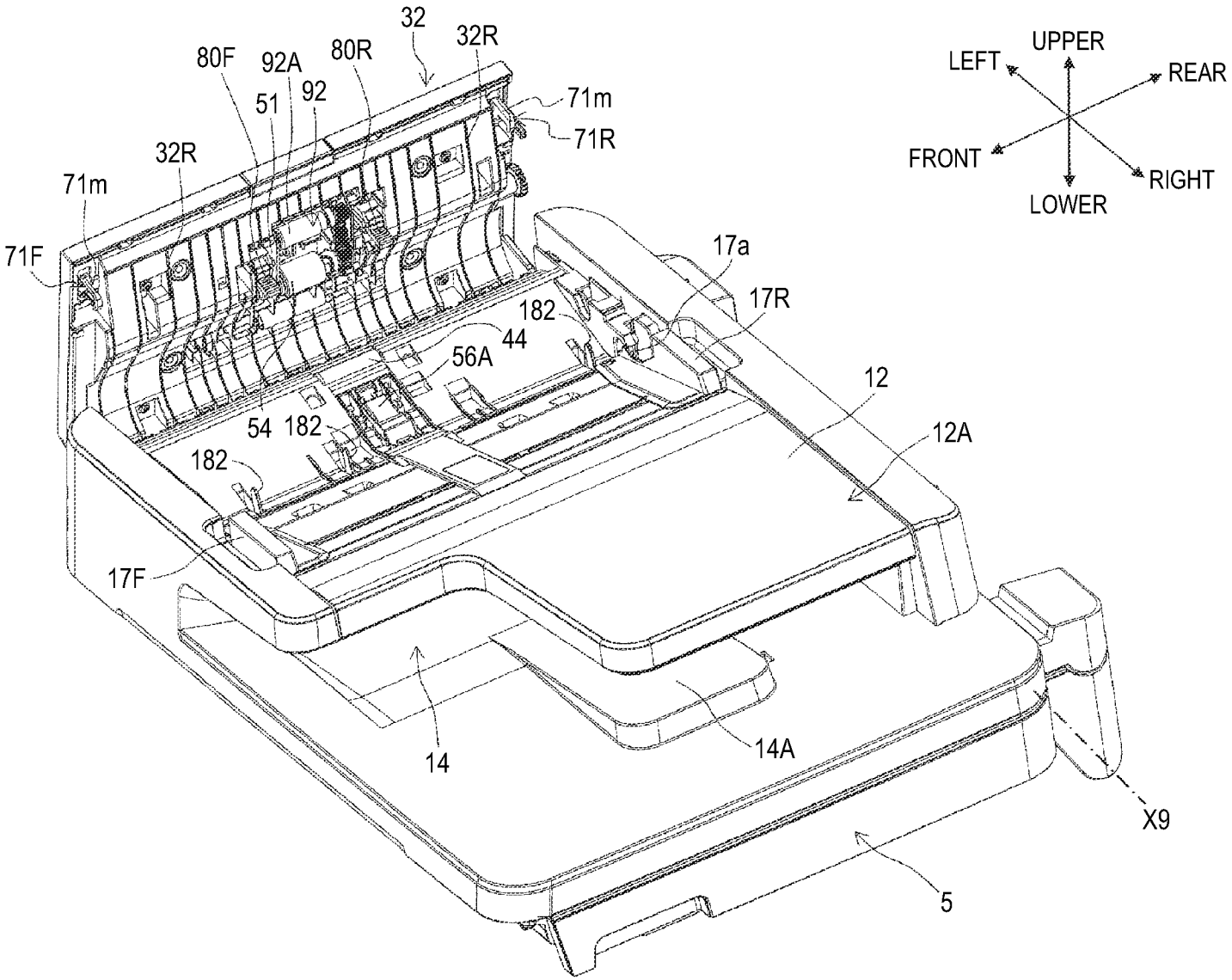
FIG. 7 is a perspective view showing a state where the opening/closing cover is opened in the structure shown in FIG. 5.

As shown in FIGS. 5 to 7, a plurality of guide ribs 32R aligned in the front and rear direction and extending in the right and left direction is formed on an inner surface of the opening/closing cover 32. Lower end edges of the guide ribs 32R form an upper guide surface 32A. The upper guide surface 32A prescribes an upper path P1A (which will be described later) of the conveying path P1, from above. As shown in FIGS. 7 and 8 and FIGS. 5 and 6, lock levers 71F and 71R for locking the opening/closing cover 32 to the device body-side are each provided in the vicinity of a front end portion and a rear end portion on an inner periphery-side of the opening/closing cover 32. In the below, the lock levers 71F and 71R are collectively referred to as 'lock lever 71' as appropriate. This also applies to the drawings. As shown in FIG. 5, the lock lever 71 is provided in a position overlapping the side guide 17 in the upper and lower direction. Note that, in FIG. 8, the lock lever 71 and the side guide 17 are shown in a broken shape in the cross-section. FIGS. 5 and 7 show a state in which the lock lever 71 is located in a lock position in which the opening/closing cover 32 is locked to the device body. FIGS. 6 and 7 show a state in which the lock lever 71 is located in a release position in which the locked state of the opening/closing cover 32 to the device body is released. The lock lever 71 is supported by the opening/closing cover 32 so as to be rotatable between the lock position and the release position.

An upper surface of the upper chute member 130 is formed with a first upper conveying surface 130A and a second upper conveying surface 130B. The first upper conveying surface 130A is a flat surface adjacent to a left end of the supply tray 12 and inclined downward to the left. The first upper conveying surface 130A of the upper chute member 130 and the sheet feeding surface 12A of the supply tray 12 constitute a stacking surface 150A on which the sheet SH is supported. A plurality of sheets SH to be read, which is to be conveyed by the conveying unit 6, is stacked on the stacking surface 150A. The first upper conveying surface 130A is an example of the support surface. The second upper conveying surface 130B is a substantially flat surface continuing to the first upper conveying surface 130A and inclined upward to the left.

A lower surface of the lower chute member 140 is formed with lower guide surfaces 140A1 and 140A2. The lower guide surface 140A1 is a substantially flat surface inclined downward to the right from the vicinity of the left end portion in the ADF unit 9 toward the reading surface 101B. The lower guide surface 140A2 is a substantially flat surface continuing to the lower guide surface 140A1 and inclined upward to the right. An upper surface of the base member 9A is formed with a lower conveying surface 140B1 facing the lower guide surface 140A1 from below and a lower conveying surface 140B2 facing the lower guide surface 140A2 from below.

The conveying path P1 of the conveying unit 6 is prescribed as a space surrounded by the first upper conveying surface 130A and second upper conveying surface 130B of the upper chute member 130, the lower guide surfaces 140A1 and 140A2 of the lower chute member 140, the upper guide surface 32A of the opening/closing cover 32, the lower conveying surfaces 140B1 and 140B2 of the base member 9A, a variety of conveying rollers and the like. More specifically, the conveying path P1 includes an upper path P1A, which is a part extending leftward from the sheet feeding surface 12A of the supply tray 12 along the first upper conveying surface 130A and second upper conveying surface 130B of the upper chute member 130. Subsequently, the conveying path P1 includes a curved path P1B, which is a part connected to the upper path P1A and curved downward. Subsequently, the conveying path P1 includes a lower path P1C consisting of a part connected to the curved path P1B, inclined downward from a lower end of the curved part toward the reading surface 101B and extending shortly rightward along the reading surface 101B, and a part inclined upward and further rightward from a right end of the reading surface 101B and reaching the discharge tray 14. The upper path P1A and the lower path P1C are overlapped in the upper and lower direction. A conveying direction of the sheet SH that is conveyed by the conveying unit 6 is a leftward direction on the upper path P1A of the conveying path P1. Regarding this, the front and rear direction is an example of the first direction intersecting with the conveying direction, and the upper and lower direction is an example of the second direction intersecting with the first direction and the conveying direction. On the curved path P1B of the conveying path P1, the conveying direction of the sheet SH changes from the leftward direction to the rightward direction, and on the lower path PC1 of the conveying path P1, the conveying direction of the sheet SH is the rightward direction. Note that, the extension direction and shape of the conveying path P1 are exemplary. Note that, on the conveying path P1, a part of the upper path P1A except the above of the sheet feeding surface 110A of the supply tray 12, the curved path P1B, and the lower path P1C are an example of the conveying route.

Configuration of Sheet Sensing Unit

Figure 9:
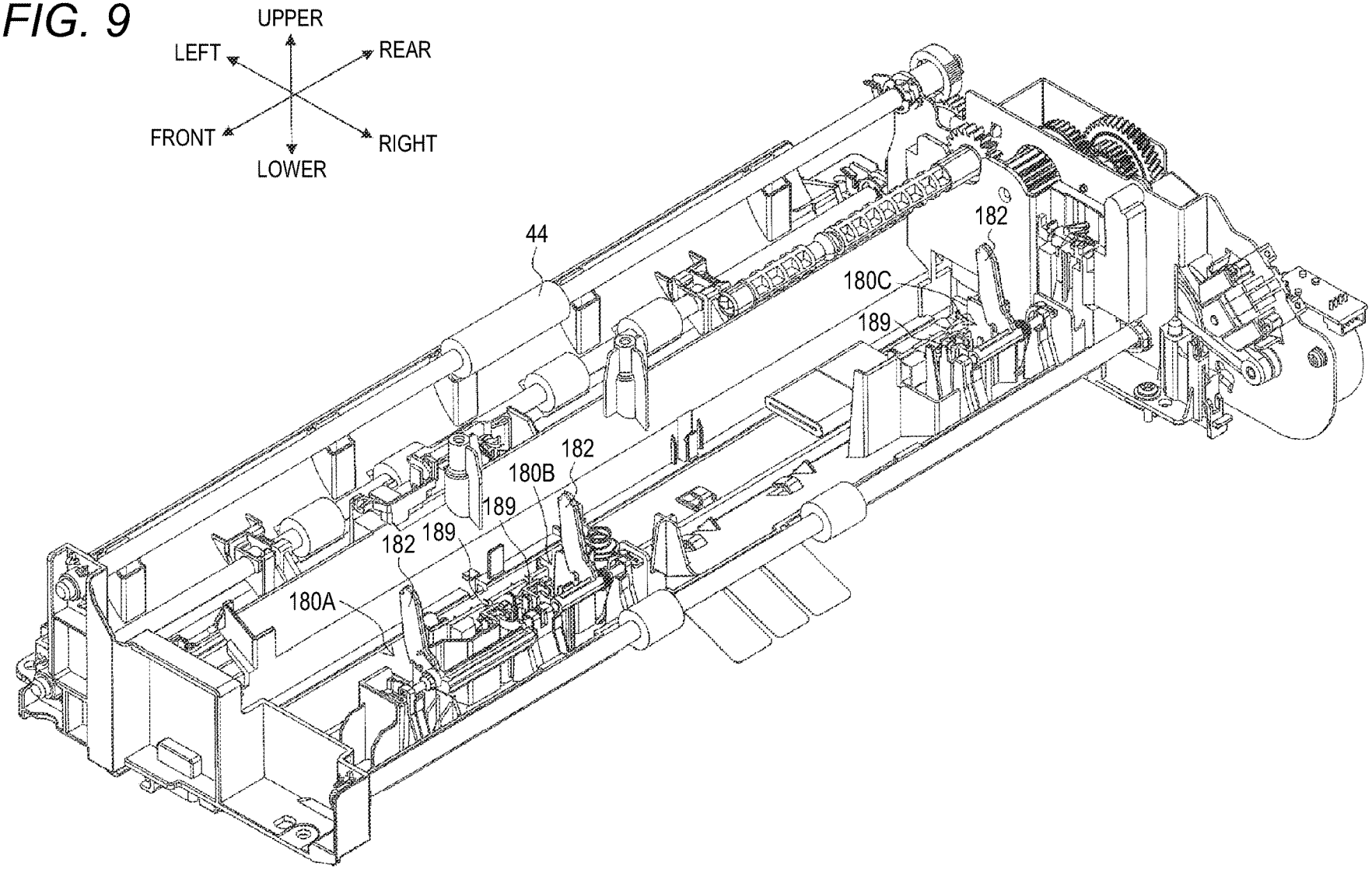
FIG. 9 is a perspective view of main parts for showing a structure mainly relating to a sheet sensing unit in the structure shown in FIG. 5.
Figure 10:
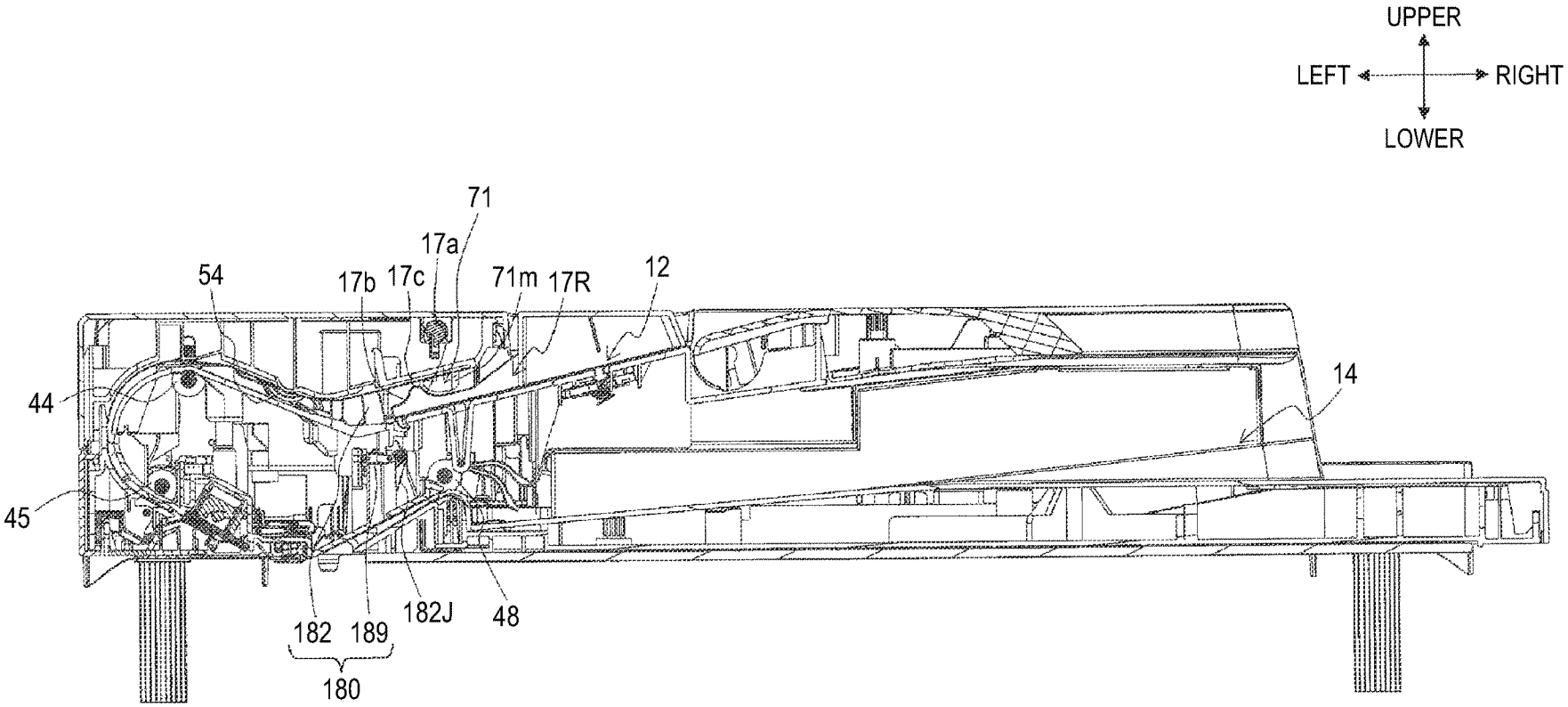
FIG. 10 is a side sectional view different from FIGS. 5 and 6, showing arrangement positions of a sensor and an actuator, as seen from rear.
Figure 11:
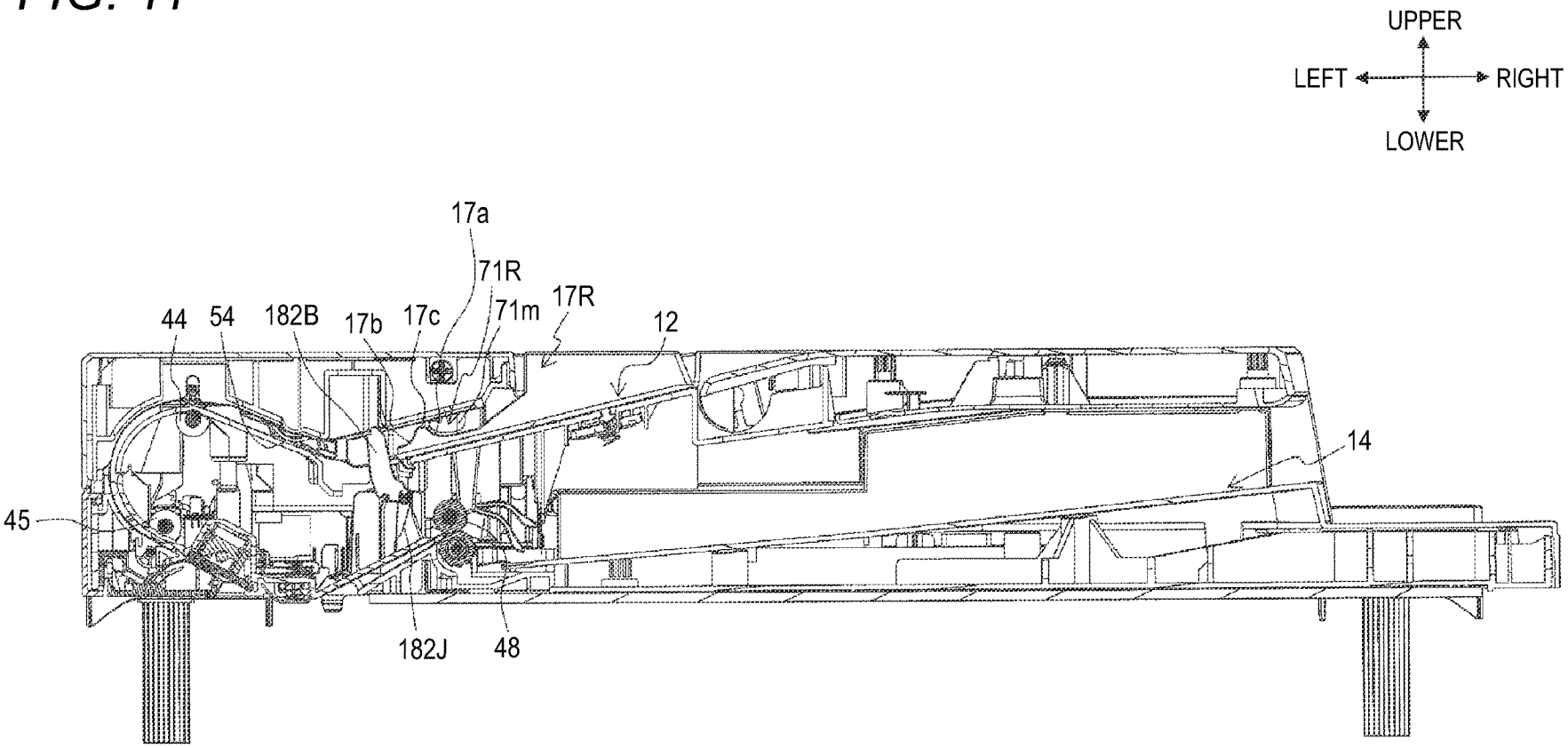
FIG. 11 is a side sectional view different from FIG. 10, as seen from rear.

A sheet sensing unit sensing that the sheet SH is placed on the supply tray 12 is provided in the vicinity of the side guide 17 on an upstream side of the supply tray 12 in the conveying direction. In this example, as shown in FIG. 9, three sheet sensing units 180A, 180B and 180C are provided from the front toward the rear. The sheet sensing units 180A, 180B and 180C have substantially the same configurations, and each include an optical sensor 189 having a light-emitting unit and a light-receiving unit, and an actuator 182. In the below, the sheet sensing units 180A, 180B and 180C are collectively referred to as 'sheet sensing unit 180' as appropriate. This also applies to the drawings. The sheet sensing unit 180 is an example of the sensing unit. FIG. 10 is a side sectional view different from FIGS. 5 and 6, showing arrangement positions of the sensor 189 and the actuator 182, as seen from rear. FIG. 11 is a side sectional view different from FIG. 10, as seen from rear. A sensing signal that is output by the sensor 189 as the actuator 182 is rotated is input to a control unit (not shown). The control unit determines whether there is the sheet SH supported on the first upper conveying surface 130A and detects a size of the conveyed sheet SH in the front and rear direction, based on the sensing signal.

Figure 12:
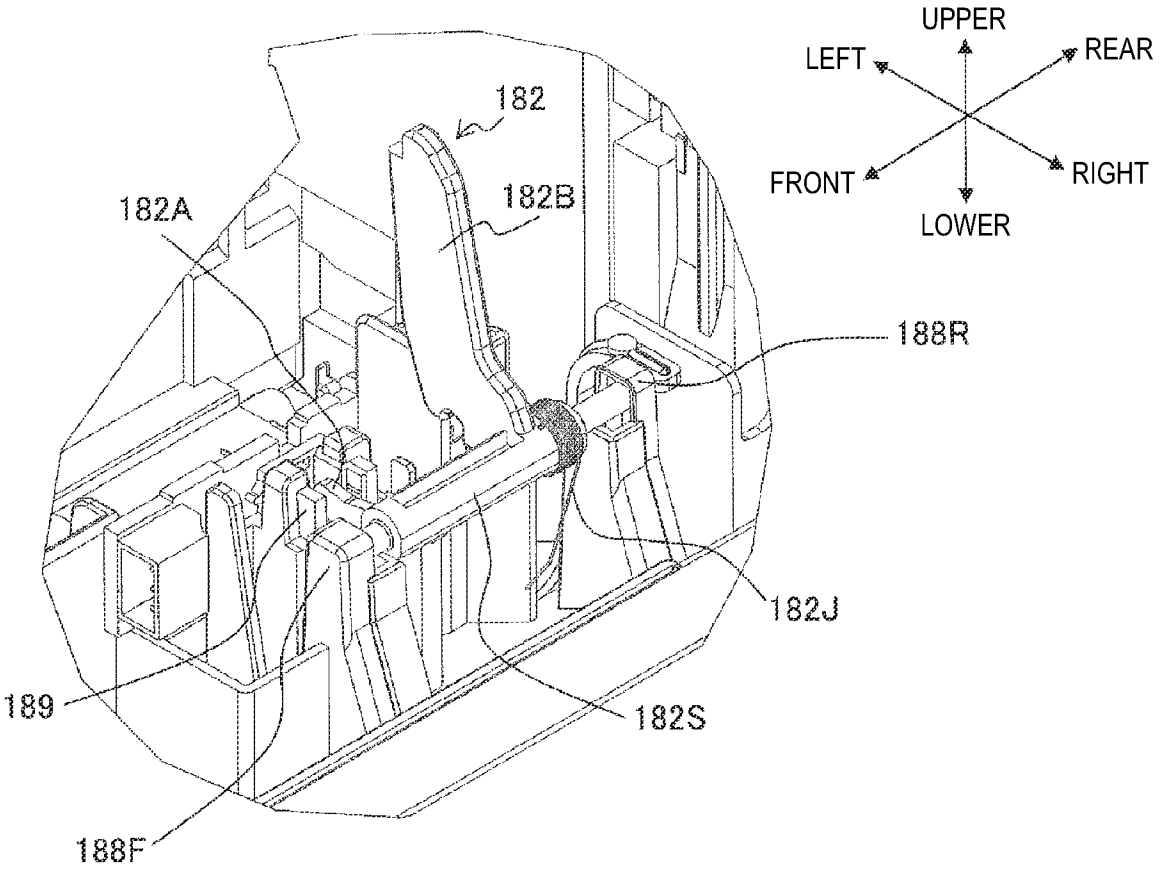
FIG. 12 is an enlarged view of main parts, showing detailed arrangement of the sensor and the actuator.
Figure 13:
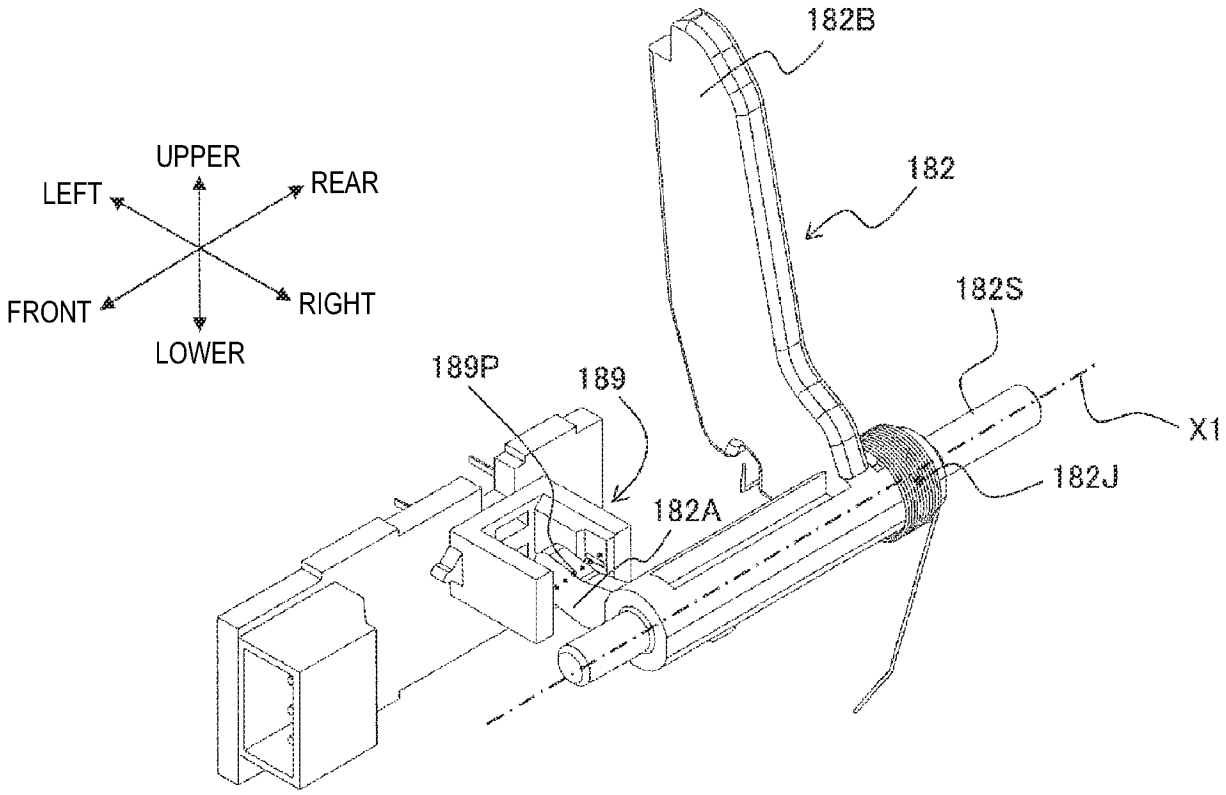
FIG. 13 is an exploded perspective view of the sensor and the actuator shown in FIG. 12.

As shown in FIG. 12, the actuator 182 has a transmission shaft 182S, a protruding piece 182B provided to protrude toward the upper path P1A, and a sensed portion 182A. As shown in FIG. 13, the transmission shaft 182S is supported to be rotatable around a shaft center X1 by actuator rotation support portions 188F and 188R shown in FIG. 12. The protruding piece 182B is positioned on a rear end-side of the transmission shaft 182S, and a front end portion of the protruding piece 182B is formed with the sensed portion 182A having a substantially rectangular plate shape. The actuator 182 is urged so that the protruding piece 182B is rotated around the shaft center X1 in a right front direction of FIGS. 12 and 13 by a spring 182J. The actuator 182 is held in a position in which the protruding piece 182B collides with a stopper (not shown) and is stopped and thus the sensed portion 182A opens a light path 189P of the sensor 189. The actuator 182 is rotated around the shaft center X1 in a left inner direction of FIGS. 12 and 13 against the spring 182J, so that the sensed portion 182A interrupts the light path 189P of the sensor 189. Note that, the spring 182J and the stopper are attached to an internal frame (not shown).

Separation Roller, Separation Pad, Feeder Roller, and the Like

As shown in FIGS. 5 to 7, the conveying unit 6 includes a separation unit 50 and a separation pad 56A. Although described later in detail, the separation unit 50 includes a separation roller 54, a holder 51, and a feeder roller 92.

The separation roller 54 is positioned at the left of the feeder roller 92, i.e., downstream of the conveying path P1 in the conveying direction. The separation roller 54 is provided in a position facing the second upper conveying surface 130B of the upper chute member 130 from above.

As shown in FIG. 5, the separation pad 56A forms the conveying surface of the sheet SH, together with the second upper conveying surface 130B. The separation pad 56A is provided in a position facing the separation roller 54 from below. The separation pad 56A is a plate-shaped body made of a soft material such as rubber, elastomer or the like. The separation pad 56A is pressed toward the separation roller 54 by an urging spring (not shown), for example.

As shown in FIGS. 5 to 7, the holder 51 accommodates the separation roller 54 sandwiched in the front and rear direction while covering the separation roller 54 from above. The holder 51 is swingably supported by a rotary shaft of the separation roller 54.

As shown in FIGS. 5 to 7, the feeder roller 92 is provided in a position facing the first upper conveying surface 130A of the upper chute member 130 from above. A position of the feeder roller 92 in the conveying direction is partially overlapped with a position of the side guide 17 in the conveying direction (refer to FIGS. 14 and 15, which will be described later). The feeder roller 92 is provided to contact the sheet SH stacked on the stacking surface 150A from above. The feeder roller 92 is positioned at the right of the separation roller 54, and is accommodated in the holder 51. The separation roller 92 is rotatably supported by the holder 51. Therefore, when the holder 51 swings upward or downward around a shaft center of the rotary shaft of the separation roller 54, the feeder roller 92 can be displaced toward or away from the stacking surface 150A. The feeder roller 92 is an example of the conveying roller.

When a motor (not shown) is driven, the separation roller 54 and the feeder roller 92 are rotated in synchronization with each other. An outer peripheral surface 92A of the feeder roller 92 applies a conveying force to the uppermost sheet SH of the sheets SH stacked on the stacking surface 150A, thereby delivering the sheet SH toward the separation roller 54. As shown in FIGS. 5 to 7, the separation roller 54 separates the sheets SH being conveyed by the feeder roller 92 one by one by cooperating with the separation pad 56A, and conveys the sheet toward a downward side of the conveying path P1 in the conveying direction.

Conveying Roller

As shown in FIG. 5, the conveying unit 6 includes a first conveying roller 44 and a pinch roller 44P at the left of the separation roller 54, i.e., in positions located downstream of the separation roller 54 in the conveying direction, on the upper path P1A of the conveying path P1. The first conveying roller 44 and the pinch roller 44P nip the sheet SH separated one by one by the separation roller 54 and the separation pad 56A to convey the sheet toward the downstream side in the conveying direction.

The conveying unit 6 also includes a curved guide surface 45G, a curved guide surface 45H, a second conveying roller 45 and a pinch roller 45P, on the curved path P1B of the conveying path P1. The curved guide surface 45G and the curved guide surface 45H face each other with a predetermined gap. The curved guide surface 45G prescribes a downwardly curved part of the curved path P1B from an outer side. The curved guide surface 45H prescribes a downwardly curved part of the curved path P1B from an inner side. The second conveying roller 45 and the pinch roller 45P are arranged at a lower end portion of the curved path P1B. The second conveying roller 45 and the pinch roller 45P nip the sheet SH being conveyed by the first conveying roller 44 and the pinch roller 44P to further convey the sheet toward the reading surface 101B. The lower guide surface 140A1 and the lower conveying surface 140B1 face each other with a predetermined gap between the first conveying roller 44 and the pinch roller 44P, thereby prescribing a left part of the lower path P1C.

The conveying unit 6 further includes a sheet discharge roller 48 and a pinch roller (not shown). The lower guide surface 140A2 and the lower conveying surface 140B2 face each other with a predetermined gap between the reading surface 101B and the sheet discharge roller 48 and pinch roller, thereby prescribing a right part of the lower path P1C.

The path formed by the lower guide surface 140A2 and the lower conveying surface 140B2 is inclined upward toward the sheet discharge roller 48 and the pinch roller at the right of a pressing member 49. The sheet discharge roller 48 has a drive shaft 48*a*, and is positioned at a right end portion of the lower guide surface 140A2 of the lower chute member 140. The pinch roller is positioned at a right end portion of the lower conveying surface 140B2. The sheet discharge roller 48 and the pinch roller nip the sheet SH passing above the reading surface 101B to discharge the sheet toward the sheet discharge surface 14A of the discharge tray 14.

Stopper

As shown in FIGS. 6 and 7, the ADF unit 9 of the present embodiment includes a pair of front and rear stoppers 80F and 80R positioned between the separation roller 54 and the feeder roller 92 and configured to be in contact with a tip end in the conveying direction of the sheet SH and to restrain a movement of the sheet SH. Note that, in the below, the front stopper 80F and the rear stopper 80R are collectively referred to as 'stopper 80' as appropriate. This also applies to the drawings.

Figure 14A:
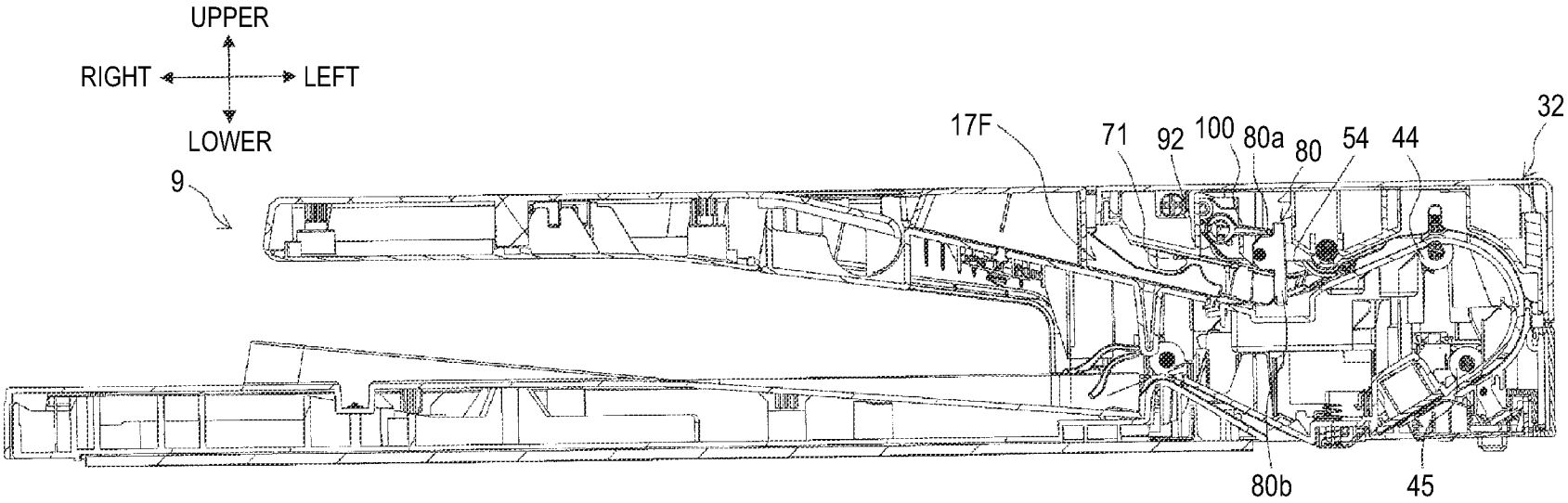
FIG. 14A is a side sectional view showing a state where a stopper is engaged to a lock lever, as seen from rear.
Figure 14B:
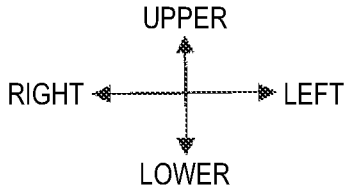
FIG. 14B is a partially enlarged view of the side sectional view showing the state where the stopper is engaged to the lock lever, as seen from rear.
Figure 15A:
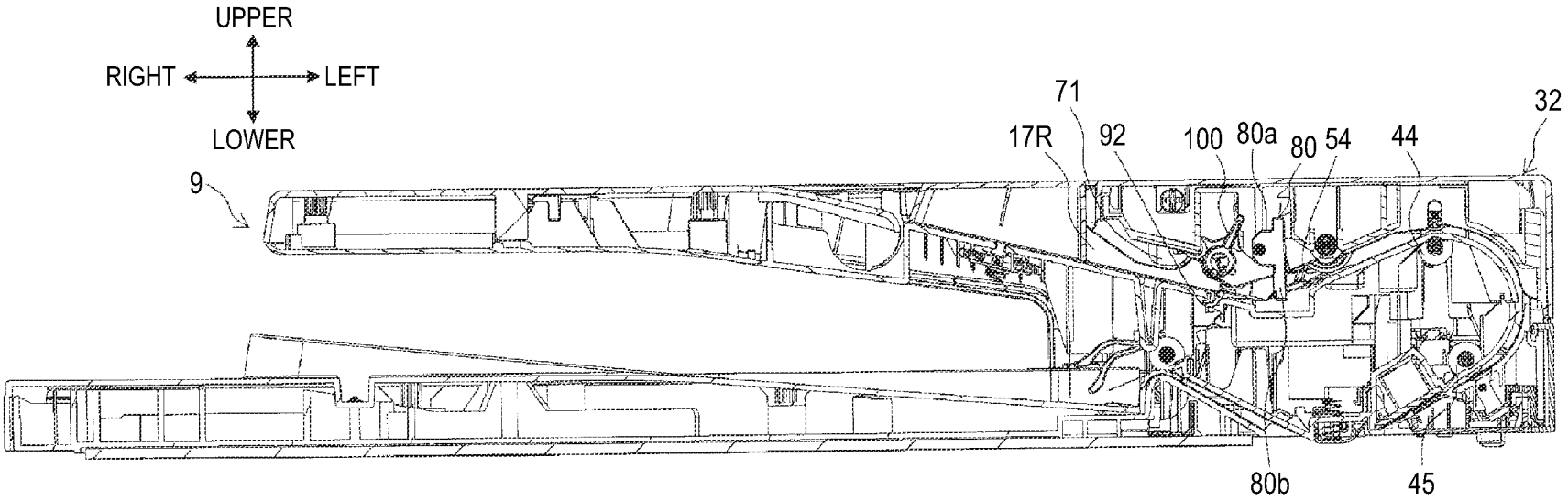
FIG. 15A is a side sectional view showing a state where engagement between the stopper and the lock lever is released, as seen from rear.
Figure 15B:
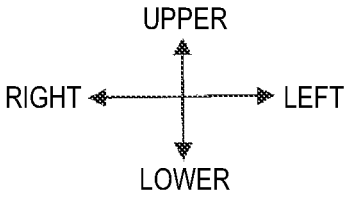
FIG. 15B is a partially enlarged view of the side sectional view showing the state where the engagement between the stopper and the lock lever is released, as seen from rear.

The stopper 80 is configured to switch a position thereof between a restraint state shown in FIGS. 14A and 14B and a restraint-released state shown in FIGS. 15A and 15B. In this example, in the restraint state, the stopper 80 is engaged with a stopper lever 100 to protrude toward the first upper conveying surface 130A prescribing the conveying path P1 of the sheet SH, thereby restraining the sheet SH from passing, as described later. A position of the stopper lever 100 in this state is an example of the first position. In the restraint-released state, the stopper 80 is released from the engaged state with the stopper lever 100 and is thus in a free state, so that it is pushed by the tip end of the sheet SH and is rotated from the first position to retreat upward away from the first upper conveying surface 130A, thereby allowing a movement of the sheet SH toward the downstream side, i.e., passing of the sheet SH. A position of the stopper lever 100 in this state is an example of the second position. Note that, the stopper 80 is supported by the opening/closing cover 32, together with the holder 51 having the separation roller 54 and the feeder roller 92.

Stopper Switching Mechanism

Subsequently, switching of the state of the stopper 80 is described with reference to FIGS. 14 and 15. As described above, the separation roller 54 and the feeder roller 92 are provided to the holder 51, and the holder 51 is swingably supported by the rotary shaft of the separation roller 54. In the state shown in FIGS. 14A and 14B, for example, the motor is rotated in a predetermined direction, so that the holder 51 swings about the shaft center of the rotary shaft of the separation roller 54 so as to lower on the feeder roller-side, based on the drive force of the motor, as shown in FIGS. 15A and 15B. Thereby, the feeder roller 92 is contacted to the sheet SH.

As described above with reference to FIGS. 6 and 7, the opening/closing cover 32 is provided with the stopper 80. The stopper 80 is supported by the opening/closing cover 32 so as to be rotatable about a shaft member 80*c* (center of rotation) shown in FIGS. 14B and 15B, and has a step portion 80*a* and a sheet restraining portion 80*b*. The stopper lever 100 is rotatably supported on a part of the holder 51 near the feeder roller 92. The stopper lever 100 is urged in an S direction shown in FIGS. 14B and 15B by an appropriate spring member (not shown). In a state before the holder 51 swings so as to lower on the feeder roller 92-side, a tip end portion 100*a* of the stopper lever 100 is in contact with and engaged with the step portion 80*a*, as shown in FIGS. 14A and 14B. Thereby, the stopper 80 is hindered from rotating and is thus in the restraint state.

When the holder 51 swings so as to lower on the feeder roller 92-side, a contacted surface 100*b* of the stopper lever 100 comes into contact with a contact rib 132 provided on the opening/closing cover 82. Thereby, the stopper lever 100 is displaced so as to rotate in an opposite direction to the S direction, as shown in FIGS. 15A and 15B. As a result, the engagement between the tip end portion 100*a* of the stopper lever 100 and the step portion 80*a* is released, so that the stopper 80 is in a rotatable state, i.e., in the restraint-released state. Thereby, the feeder roller 92 can convey the sheet SH to the curved path P1B.

On the other hand, for example, the motor is rotated in an opposite direction to the above direction, so that the holder 51 swings so as to rise on the feeder roller 92-side, as shown in FIGS. 14A and 14B. Thereby, the feeder roller 92 is spaced from the sheet SH. As described above with reference to FIGS. 15A and 15B, the stopper lever 100 lifted as a result of the contacted surface 100*b* coming into contact with the contact rib 132 is displaced so as to rotate in the S direction, as shown in FIGS. 14A and 14B. As a result, the tip end portion 100*a* of the stopper lever 100 and the step portion 80*a* are engaged, so that the stopper 80 is in the restraint state.

Features of Embodiment

As for the ADF unit 9, the features of the present embodiment are shapes of the side guide 17 and the lock lever 71. This is described in detail, as follows.

Notched Portion and Support Wall Portion of Side Guide

Figure 16:
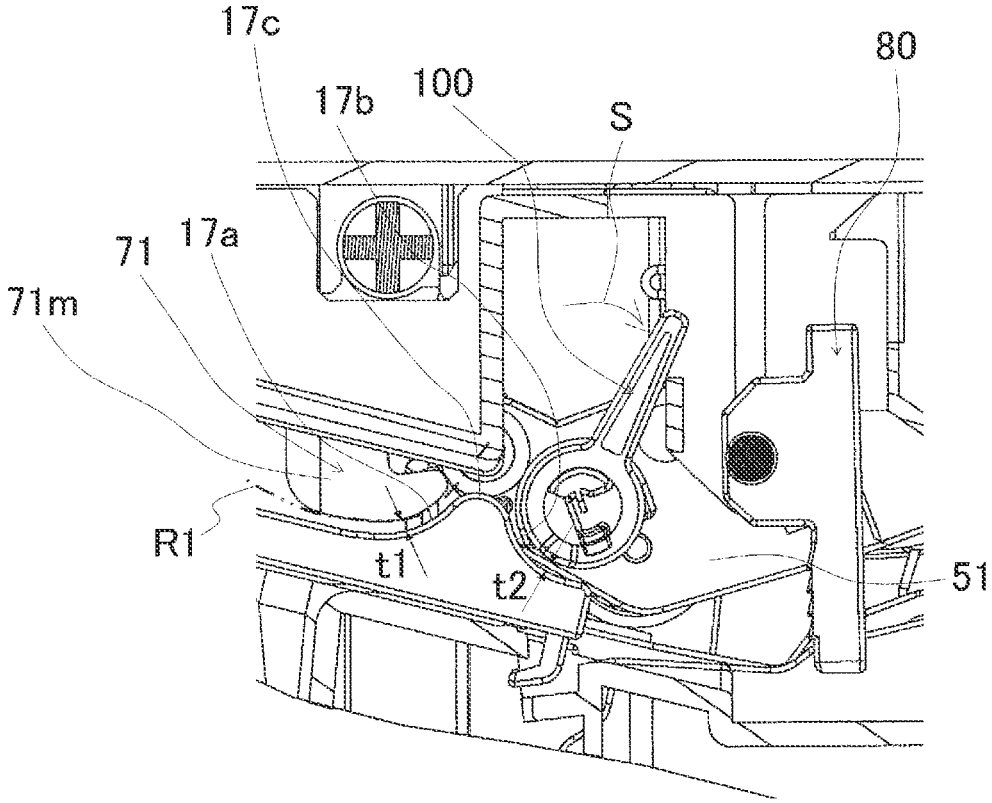
FIG. 16 is an enlarged sectional view of main parts, showing a vicinity of a notched portion of the side guide shown in the partially enlarged view of FIG. 15B.
Figure 17:
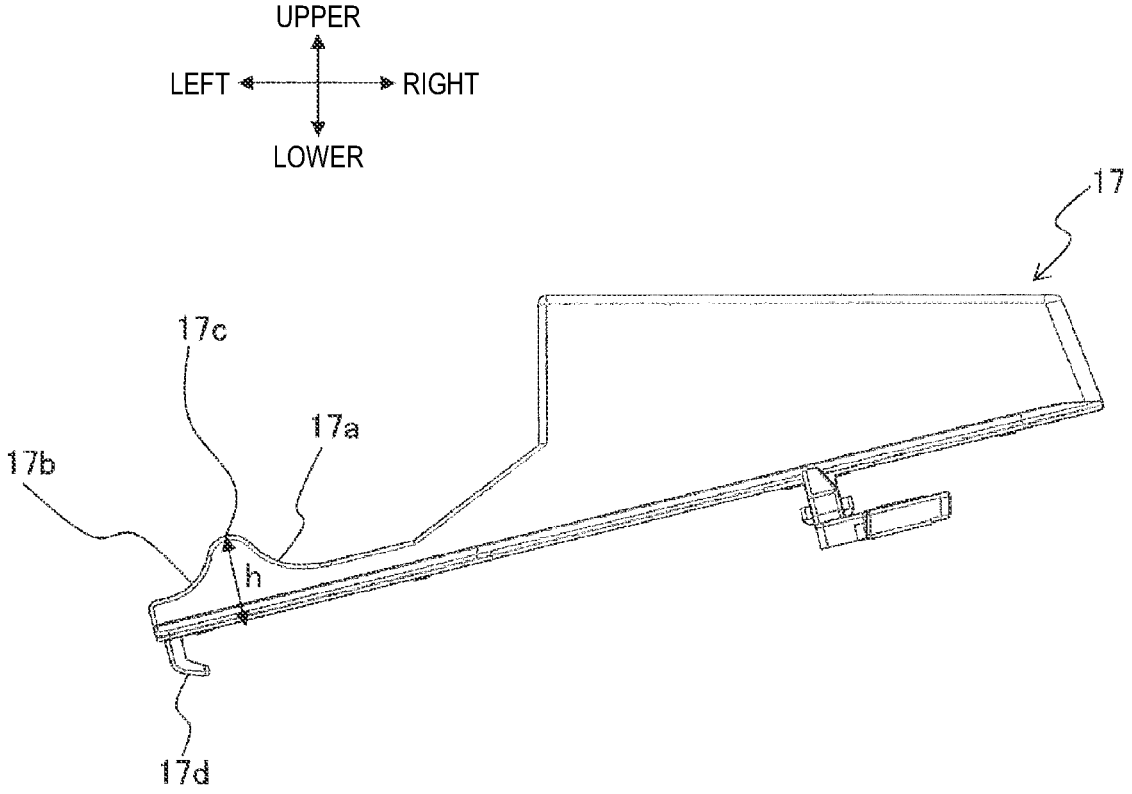
FIG. 17 is an appearance view showing a detailed structure of the side guide.

FIG. 17 shows a detailed appearance shape of the side guide 17, as seen from front. In the present embodiment, as described above with reference to FIG. 5 and the like, the position of the lock lever 71 and the position of the side guide 17 are overlapped in the upper and lower direction. Regarding this, as shown in FIGS. 16 and 17 and the like, which are enlarged views of main parts of FIGS. 15A and 15B, the side guide 17 is provided with a notched portion 17*a* configured to face a rotation track of the lock lever 71 with a predetermined gap t1. Note that, in FIG. 16, the rotation track is shown with a curve R1. The notched portion 17*a* is an example of the first notched portion. In the present embodiment, as shown in FIGS. 14 and 15, and the like, the position of the stopper lever 100 and the position of the side guide 17 are overlapped in the upper and lower direction. Regarding this, the side guide 17 is provided with a notched portion 17*b* configured to face a rotation track of the stopper lever 100 rotating between the restraint state shown in FIGS. 14A and 14B and the restrain-released state shown in FIGS. 15A and 15B with a predetermined gap t2. The notched portion 17*b* is an example of the second notched portion.

Figure 14B:
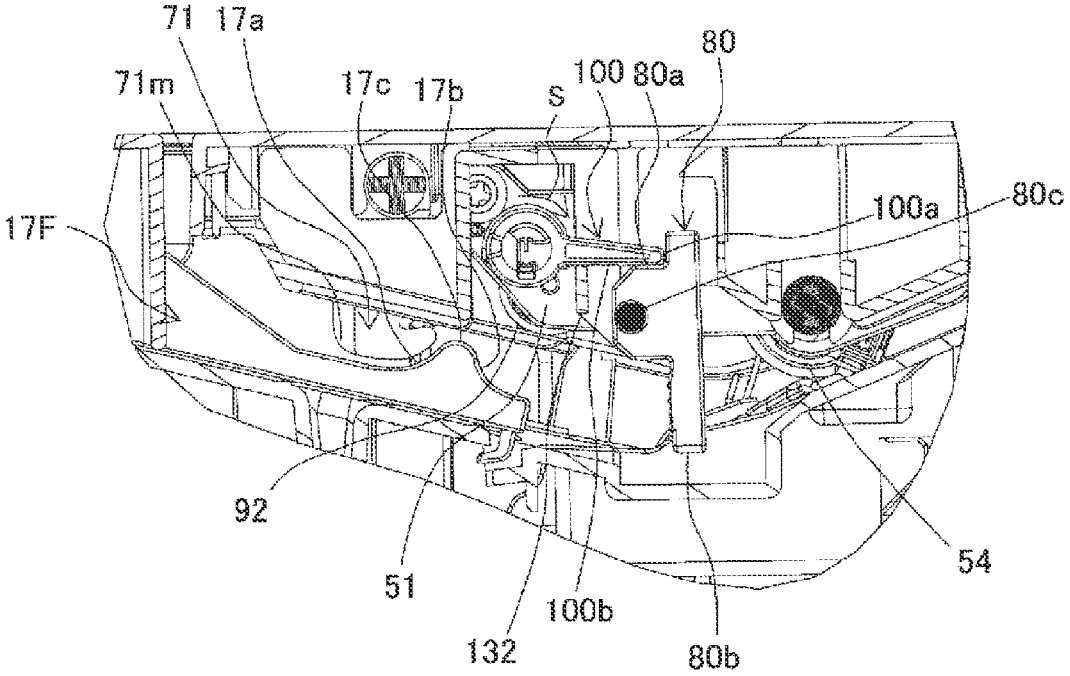
Figure 15B:
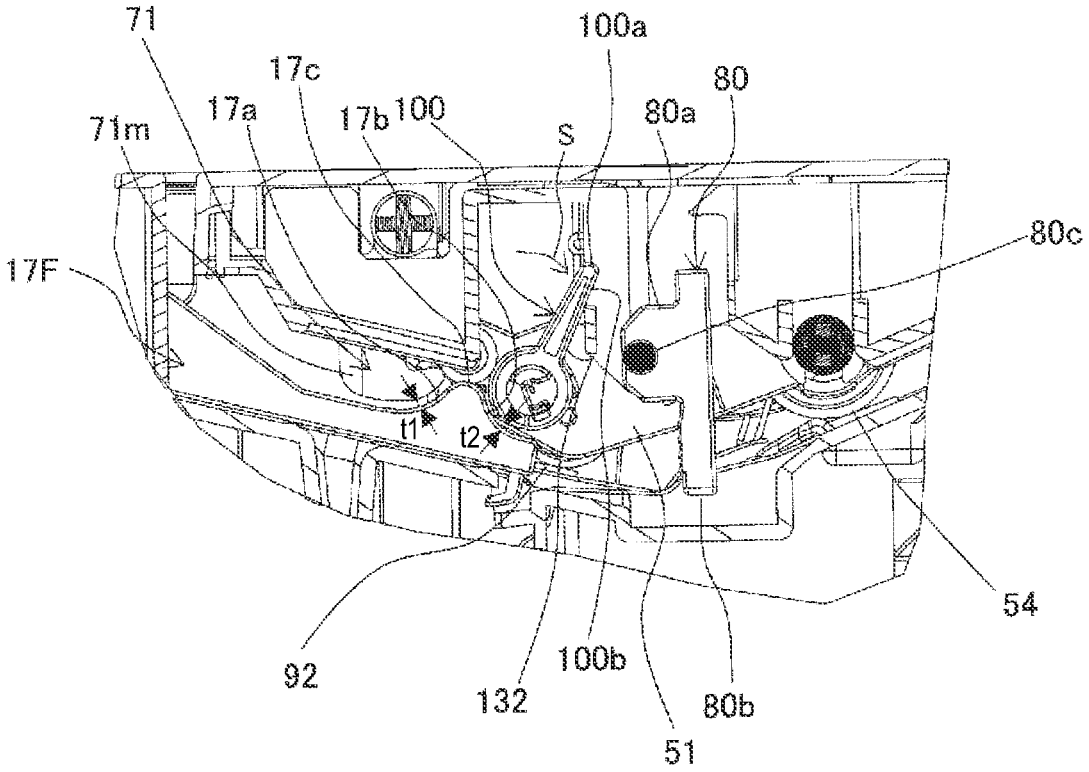

As shown in FIG. 17 and FIGS. 14 and 15, and the like, a support wall portion 17*c* is provided on a side of the side guide 17 located downstream of the notched portion 17*a* and upstream of the notched portion 17*b* in the conveying direction, i.e., between the notched portions 17*a* and 17*b*. A dimension in the upper and lower direction of the support wall portion 17*c*, i.e., a height dimension h is set equal to or greater than a dimension of a predetermined number of sheets SH in a thickness direction. The predetermined number of sheets is, for example, the maximum stacking number of sheets on the supply tray 12, and for example, is about several tens of sheets to about one hundred sheets.

Arrangement of Lock Lever and Guide Surface

Figure 8:
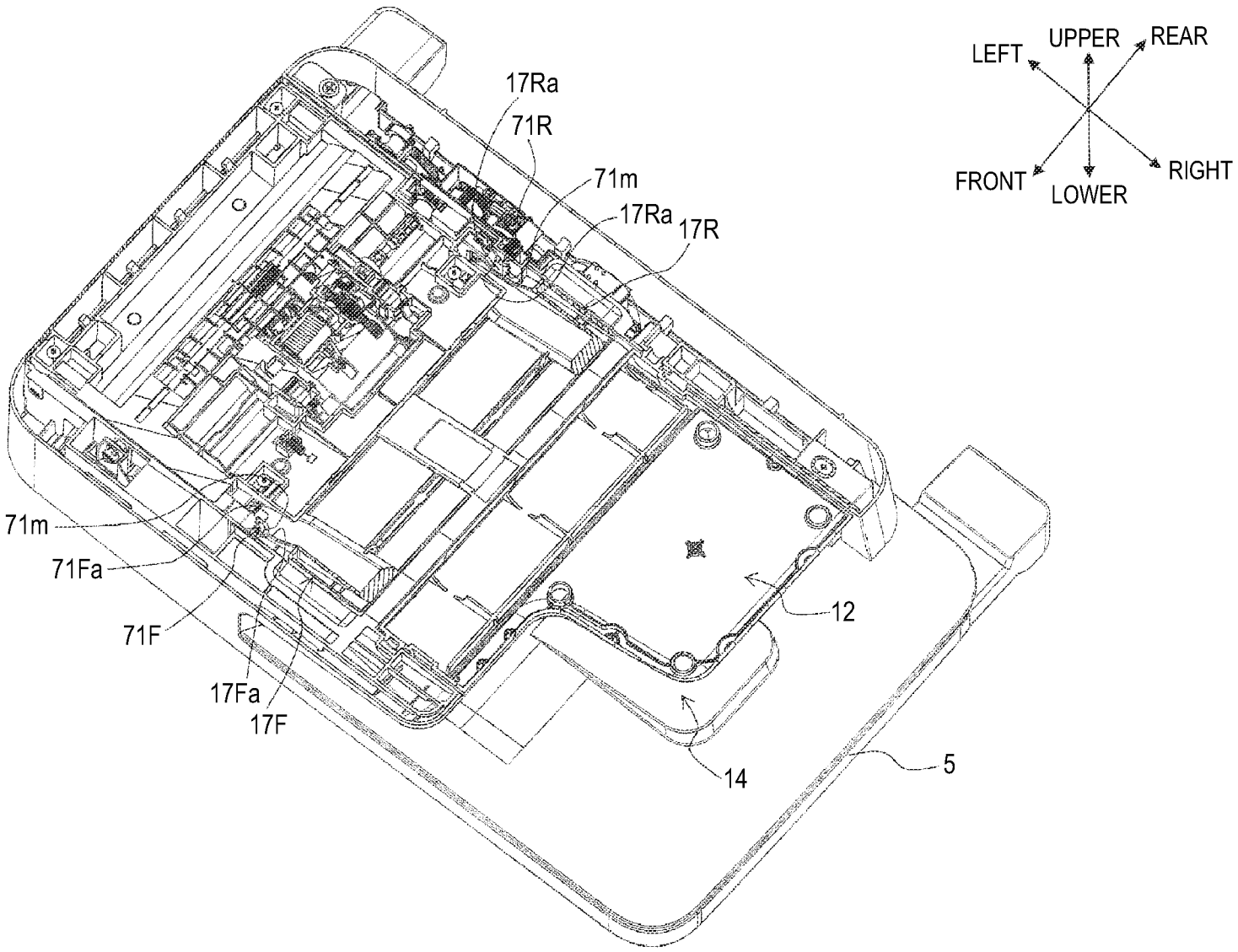
FIG. 8 is a sectional view showing a state broken in a substantially horizontal section where the opening/closing cover is omitted from the structure shown in FIG. 5.

As described above, in the present embodiment, the side guides 17F and 17R are in contact with the front end portion and the rear end portion of the sheet SH placed on the supply tray 12. Regarding this, in the present embodiment, as shown in FIGS. 7 and 8, and the like, an inner-side end portion of each lock lever 71 in the front and rear direction is located on an outermore side than the side guide 17 in the front and rear direction, i.e., on an opposite side to the sheet SH. Specifically, as shown in FIG. 8, a front-side end portion 71Ra of the lock lever 71R is located at the rear of a portion 17Ra, which faces the lock lever 71R, of the second side guide 17R. A rear-side end portion 71Fa of the lock lever 71F is located at the front of a portion 17Fa, which faces the lock lever 71F, of the second side guide 17F.

An inner-side portion of each lock lever 71 in the front and rear direction is provided with a guide surface 71*m* configured to guide the sheet SH so that the sheet is placed in the supply tray 12. Specifically, as shown in FIGS. 7, 8 and 10, and the like, the guide surface 71*m* is formed near the right end portion of the lock lever 71R, as an inclined surface facing toward the right front direction in the state where the opening/closing cover 32 is in the closed position. The guide surface 71*m* is formed near the right end portion of the lock lever 71F, as an inclined surface facing toward the right rear direction in the state where the opening/closing cover 32 is in the closed position.

Floating Prevention Structure of Side Guide, and the Like

Figure 18:
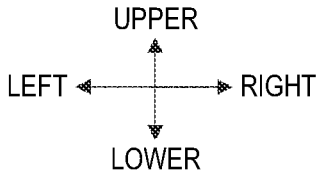
FIG. 18 is an enlarged sectional view of main parts, showing an engaging structure by an engaging claw of the side guide, together with a sheet sensing unit, as seen from front.
Figure 18:
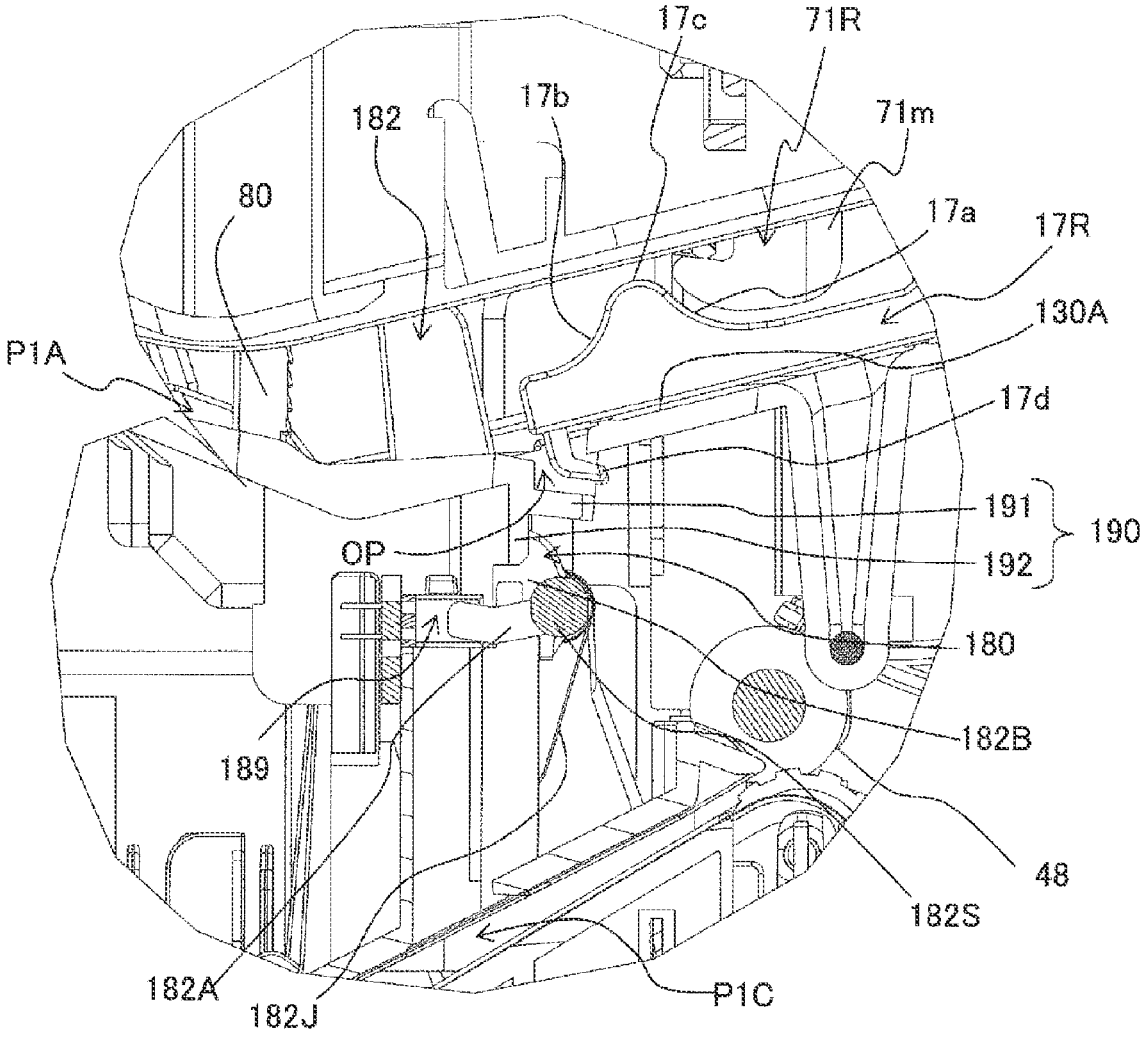

As shown in FIGS. 17 and 18, and the like, an engaging claw 17*d* for floating prevention, which protrudes substantially downward in a key shape, is provided near a downstream-side end portion, i.e., near the left end portion of the side guide 17 in the conveying direction. The engaging claw 17*d* is an example of the engaging portion. Regarding this, as shown in FIG. 18, the first upper conveying surface 130A of the upper chute member 130 is formed with an opening OP linearly extending in the front and rear direction and provided so as to receive and engage with the engaging claw 17*d*. The opening OP is an example of the engaged portion. As shown in FIG. 18, the sheet sensing unit 180 having the sensor 189 and the actuator 182 is provided in a position overlapping the opening OP substantially in the upper and lower direction. A light shield portion 190 for shielding outside light incident through the opening OP is provided between the sensor 189 of the sheet sensing unit 180 and the opening OP. The light shield portion 190 has a horizontal wall part 191 arranged substantially in a horizontal direction so as to follow a tip end-side of the engaging claw 17*d*, and a vertical wall part 192 arranged substantially in a vertical direction.

Effects of Embodiment

As described above, in the present embodiment, the side guide 17 supported on the supply tray 12 is movable in the front and rear direction. Thereby, when placing the sheet SH on the supply tray 12, the user can smoothly insert the sheet SH into the conveying path P1 while aligning the sheet SH by bringing the side guide 17 into contact with the end portion of the sheet SH in the front and rear direction. The opening/closing cover 32 covering the conveying path P1 is provided to be rotatable with respect to the device body having the supply tray 12, and the user can appropriately expose the conveying path P1 by opening the opening/closing cover 32. In the state where the opening/closing cover 32 is closed, the opening/closing cover 32 is locked to the device body by the lock lever 71.

In a case where the position of the lock lever 71 and the position of the side guide 17 are overlapped in the upper and lower direction, the entire device may be enlarged in the upper and lower direction so as to avoid the interference. In the present embodiment, the side guide 17 is provided with the notched portion 17*a* configured to face the rotation track of the lock lever 71 with the gap t1. Thereby, since the positions of the lock lever 71 and the side guide 17 can be arranged closer to each other in the upper and lower direction by a dimension of the notched shape, the increase in dimension of the entire ADF unit 9 in the upper and lower direction can be suppressed.

As a result, according to the present embodiment, it is possible to avoid the interference between the lock lever 71 and the side guide 17 while suppressing the increase in dimension of the entire ADF unit 9 in the upper and lower direction.

In addition, in the present embodiment, particularly, the stopper 80 and the stopper lever 100 for switching the state of the stopper 80 are provided. When the stopper lever 100 is rotated to the first position, the stopper 80 is in the restraint state where the stopper 80 restrains the sheet SH placed on the supply tray 12 from passing into the conveying direction. Thereby, the stopper is in contact with the tip end of the sheet SH inserted by the user, and catches the sheet SH, so that the sheet SH can be positionally aligned in a predetermined position on the conveying path P1. When the stopper lever 100 is rotated to the second position, the stopper is in the restraint-released state where the stopper 80 allows the sheet SH to pass into the conveying direction. Thereby, the sheet SH caught as described above can be sent toward the downstream side of the conveying path P1.

In a case where the position of the stopper lever 100 and the position of the side guide 17 are overlapped in the upper and lower direction, the entire device may be enlarged in the upper and lower direction so as to avoid the interference, like the case of the lock lever 71. In the present embodiment, the side guide 17 is provided with the notched portion 17*b* configured to face the rotation track of the stopper lever 100 with the gap t2. Thereby, the positions of the lock lever 100 and the side guide 17 can be arranged closer to each other in the upper and lower direction, as described above, so that the increase in dimension of the entire device in the upper and lower direction can be suppressed.

Further, in the present embodiment, particularly, the support wall portion 17*c* is provided between the notched portion 17*a* and the notched portion 17*b* of the side guide 17. The dimension h of the support wall portion 17*c* in the upper and lower direction is preset equal to or greater than the dimension of the predetermined number of sheets SH in the thickness direction. Thereby, even with the side guide 17 notched in the upper and lower direction as described above, it is possible to appropriately guide the sheet SH stacked on the supply tray 12 by the support wall portion 17*c*.

Further, in the embodiment, particularly, the sheet SH placed on the supply tray 12 is sent to the conveying path P1 by the feeder roller 92. The feeder roller 92 is arranged so that a position in the conveying direction partially overlaps the position of the side guide 17 in the conveying direction. The side guide 17 extends up to a position close to the feeder roller 92 in the conveying direction, and the sheet SH is introduced to the feeder roller 92 with being appropriately aligned by the side guide 17, so that the conveying accuracy of the sheet SH can be improved.

As described above, the side guide 17 is in contact with the end portion in the front and rear direction of the sheet SH placed on the supply tray 12. In the present embodiment, the inner-side end portions 71Fa and 71Ra of the lock levers 71F and 71R in the front and rear direction are located on the outermore sides than the corresponding side guides 17F and 17R in the front and rear direction, i.e., on the opposite sides to the sheet SH. Thereby, the lock lever 71 can be made not to interfere with the conveying of the sheet SH placed on the inner side of the side guide 17.

As described above, the lock lever 71 is positioned on the opposite side to the sheet SH from the side guide 17. However, when the user places the sheet SH on the inner side of the side guide 17 in the front and rear direction, a slight deviation may occur, so that the sheet SH may be placed with protruding outside the side guide 17 in the front and rear direction. Regarding this, in the present embodiment, the inner portion in the front and rear direction of each of the lock levers 71F and 71R positioned outside the side guides 17F and 17R in the front and rear direction is provided with the guide surface 71*m*. Thereby, even when the user places the sheet SH in a state where the sheet protrudes slightly outward, as described above, it is possible to guide the sheet SH to the inner side and to appropriately place the sheet by the guide surface 71*m*. Specifically, the lock lever 71 has both a function of locking the opening/closing cover 32 and a function of guiding the sheet SH.

The side guide 17 provided on the supply tray 12 so as to be movable in the front and rear direction may slightly rattle with respect to the supply tray 12, due to the movable structure. In the present embodiment, the end portion on the downstream side of the side guide 17 in the conveying direction is provided with the engaging claw 17*d*, and the engaging claw 17*d* is engaged with the opening OP provided for the first upper conveying surface 130A which supports the sheet SH in the conveying path P1. By the engaging structure, it is possible to suppress the end portion on the downstream side of the side guide 17 from floating from the supply tray 12, so that it is possible to move the side guide 17 without spreading apart the same when operating the side guide 17. As a result, it is possible to improve the operability of the side guide 17.

Further, in the present embodiment, particularly, the sheet SH supported on the first upper conveying surface 130A is optically sensed by the sheet sensing unit 180. In the structure where the engaging claw 17*d* of the side guide 17 is engaged with the opening OP of the first upper conveying surface 130A, as described above, when the sheet sensing unit 180 is provided in a position overlapping the opening OP in the upper and lower direction, the outside light may be incident from the engaging structure portion, thereby badly influencing the sensing performance of the sensor 189 of the sheet sensing unit 180. In the present embodiment, the light shield portion 190 is provided between the opening OP and the sheet sensing unit 180, so that it is possible to shield the outside light that is incident as described above. Therefore, it is possible to suppress the lowering of the sensing performance of the sheet sensing unit 180 and to maintain the sensing accuracy.

Note that, the present invention is not limited to the above embodiment, and can be diversely changed without departing from the gist and technical spirit of the present invention. In the below, modified embodiments are described. The modified embodiments are also included within the technical scope of the present invention.

In the above, the opening/closing cover 32 and the lock lever 71 are constituted as separate components. However, the present invention is not limited thereto. For example, the opening/closing cover and the lock lever may also be integrally constituted. Also in this case, the similar effects can be achieved.

In the above, the two lock levers 71F and 71R and the two stoppers 80F and 80R are provided, and the two side guides 17F and 17R face the corresponding lock levers 71F and 71R and stopper levers 100. However, the present invention is not limited thereto. Specifically, each of the lock lever 71 and the stopper 80 may be provided by only one, and any one of the pair of side guides 17F and 17R may face one lock lever 71 and one stopper lever 100. Also in this case, the similar effects can be achieved.

Although not specifically exemplified, the present disclosure is put into practice with various changes made within a range not departing from the gist of the present invention.

What is claimed is:

1. The sheet conveying device comprising:

a tray on which a sheet is placed;

a device body having a conveying route through which the sheet is conveyed in a conveying direction, and supporting the tray;

a side guide supported by the tray to be movable in a first direction intersecting with the conveying direction, and capable of contacting an end portion in the first direction of the sheet placed on the tray;

a cover provided to be rotatable with respect to the device body, and covering the conveying route; and a protrusion provided in a position overlapping the side guide in a second direction intersecting with the conveying direction and the first direction, a stopper that is displaceable between a restraint state in which the stopper is in contact with a tip end of the sheet placed on the tray to restrain the sheet from passing into the conveying direction and a restraint-released state in which the stopper allows the sheet to pass into the conveying direction; and a stopper lever provided to be rotatable between a first position in which the stopper lever sets the stopper to the restraint state and a second position in which the stopper lever sets the stopper to the restraint-released state, wherein the side guide includes:

a first notched portion configured to face the protrusion with a predetermined gap; and a second notched portion provided on a further downstream side than the first notched portion in the conveying direction, and configured to face a rotation track of the stopper lever with a predetermined gap.

2. The sheet conveying device according to claim 1, wherein the side guide further includes a support wall portion provided downstream of the first notched portion and upstream of the second notched portion in the conveying direction, and wherein a dimension of the support wall portion in the second direction is equal to or greater than a dimension of a predetermined number of the sheets in a thickness direction.

3. The sheet conveying device according to claim 1, further comprising:

a conveying roller that sends the sheet placed on the tray toward the conveying route, wherein a position of the conveying roller in the conveying direction is partially overlapped with a position of the side guide in the conveying direction.

4. The sheet conveying device according to claim 1, wherein a position of an inner-side end portion of the protrusion in the first direction is located on an outermore side in the first direction than a position of the side guide corresponding to the protrusion.

5. The sheet conveying device according to claim 1, wherein the side guide includes an engaging portion provided at an end portion of the side guide on a downstream side in the conveying direction, and configured to prevent the side guide from floating, and wherein the device body has:

a support surface that supports the sheet in the conveying route; and an engaged portion provided on the support surface, and configured to be engaged with the engaging portion.

6. A sheet conveying device comprising:

a tray on which a sheet is placed;

a device body having a conveying route through which the sheet is conveyed in a conveying direction, and supporting the tray;

a side guide supported by the tray to be movable in a first direction intersecting with the conveying direction, and capable of contacting an end portion in the first direction of the sheet placed on the tray;

a cover provided to be rotatable with respect to the device body, and covering the conveying route; and a protrusion provided in a position overlapping the side guide in a second direction intersecting with the conveying direction and the first direction, wherein the side guide includes a first notched portion configured to face the protrusion with a predetermined gap;

wherein the side guide includes an engaging portion provided at an end portion of the side guide on a downstream side in the conveying direction, and configured to prevent the side guide from floating, and wherein the device body has:

a support surface that supports the sheet in the conveying route; and an engaged portion provided on the support surface, and configured to be engaged with the engaging portion;

wherein the device body further includes:

a sensing unit configured to optically sense the sheet supported on the support surface, and provided in a position overlapping the engaged portion in the second direction; and a light shield portion provided between the engaged portion and the sensing unit.

7. The sheet conveying device according to claim 6, further comprising:

a conveying roller that sends the sheet placed on the tray toward the conveying route, wherein a position of the conveying roller in the conveying direction is partially overlapped with a position of the side guide in the conveying direction.

* * * * *